US011398187B2

(12) United States Patent
Ueno

(10) Patent No.: US 11,398,187 B2
(45) Date of Patent: Jul. 26, 2022

(54) DISPLAY DEVICE AND METHOD FOR DRIVING SAME

(71) Applicant: SHARP KABUSHIKI KAISHA, Sakai (JP)

(72) Inventor: Tetsuya Ueno, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/982,530

(22) PCT Filed: Mar. 28, 2018

(86) PCT No.: PCT/JP2018/012756

§ 371 (c)(1),
(2) Date: Sep. 18, 2020

(87) PCT Pub. No.: WO2019/186765

PCT Pub. Date: Oct. 3, 2019

(65) Prior Publication Data

US 2021/0005139 A1 Jan. 7, 2021

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01); *G09G 2330/028* (2013.01)

(58) Field of Classification Search
None
See application file for complete search history.

(56) References Cited

U.S. PATENT DOCUMENTS 10,551,903 B2 * 2/2020 An ..... G06F 1/3265
2012/0001893 A1 1/2012 Jeong et al.
2013/0032806 A1 2/2013 Kimura
2014/0035890 A1 2/2014 Jinta et al.
(Continued)

FOREIGN PATENT DOCUMENTS

JP 2010-262251 A 11/2010
JP 2011-033678 A 2/2011
(Continued)

*Primary Examiner* — Nitin Patel
*Assistant Examiner* — Amen W Bogale
(74) *Attorney, Agent, or Firm* — ScienBiziP, P.C.

(57) ABSTRACT

The present disclosure discloses a current-driven display device that uses an internal compensation method and can display a good-quality image with no bright dots that are not included in intended display content. In a pixel circuit of an organic EL display device, a gate voltage of a drive transistor is initialized before the voltage of a data signal line is written to a holding capacitor via the diode-connected drive transistor. A first initialization voltage line for initialization of the gate voltage and a second initialization voltage line for initialization of an anode voltage of the organic EL element are connected to the pixel circuit. In the initialization of the gate voltage, a voltage of the first initialization voltage line that is higher than the voltage of the second initialization voltage line is provided to the gate terminal of the drive transistor via the first initialization transistor.

15 Claims, 15 Drawing Sheets

(56) References Cited

U.S. PATENT DOCUMENTS

| | | | | |
|---|---|---|---|---|
| 2016/0217739 | A1* | 7/2016 | Kang | G09G 3/3233 |
| 2016/0321995 | A1* | 11/2016 | Shin | G09G 3/3258 |
| 2016/0335950 | A1* | 11/2016 | Kang | G09G 3/3275 |
| 2017/0061875 | A1* | 3/2017 | Cho | G09G 3/3233 |
| 2017/0365218 | A1 | 12/2017 | Jeong et al. | |
| 2018/0144684 | A1* | 5/2018 | Jeon | G09G 3/3266 |
| 2018/0174525 | A1* | 6/2018 | Kim | G09G 3/3291 |
| 2019/0164494 | A1* | 5/2019 | Bae | G09G 3/3258 |
| 2019/0172888 | A1* | 6/2019 | Choi | H01L 51/5218 |
| 2019/0221165 | A1* | 7/2019 | Park | G09G 3/3291 |
| 2019/0287458 | A1* | 9/2019 | Park | H01L 27/3276 |
| 2020/0027401 | A1* | 1/2020 | Park | G09G 3/3266 |
| 2021/0134227 | A1* | 5/2021 | Im | G09G 3/3258 |

FOREIGN PATENT DOCUMENTS

| | | | |
|---|---|---|---|
| JP | 2012-014136 | A | 1/2012 |
| JP | 2013-054346 | A | 3/2013 |
| JP | 2014-029438 | A | 2/2014 |
| JP | 2017-223955 | A | 12/2017 |

* cited by examiner

DISPLAY DEVICE AND METHOD FOR DRIVING SAME

TECHNICAL FIELD

The disclosure relates to a display device, and more particularly to a current-driven display device including a display element driven by a current, such as an organic electro luminescence (EL) display device, and a method for driving the display device.

BACKGROUND ART

The last few years have seen the implementation of organic EL display devices provided with a pixel circuit including organic EL elements (also referred to as organic light-emitting diodes (OLEDs)). The pixel circuit in such an organic EL display device includes a drive transistor, a write control transistor, and a holding capacitor in addition to the organic EL elements. A thin film transistor is used for the drive transistor and the write control transistor. The holding capacitor is connected to a gate terminal that serves as a control terminal of the drive transistor. A voltage corresponding to an image signal representing an image to be displayed (more specifically, a voltage indicating the gradation values of pixels to be formed by the pixel circuit, hereinafter referred to as "data voltage") is applied to the holding capacitor from the drive circuit via a data signal line. The organic EL element is a self-luminous display element that emits light with luminance according to an electric current flowing through the organic EL element. The drive transistor is connected to the organic EL element in series and controls the electric current passing through the organic EL element according to a voltage held by the holding capacitor.

Variation and fluctuation occur in characteristics of the organic EL element and the drive transistor. Thus, variation and fluctuation in characteristics of these elements need to be compensated in order to perform higher picture quality display in the organic EL display device. For the organic EL display device, a method for compensating a characteristic of an element inside a pixel circuit and a method for compensating a characteristic of an element outside a pixel circuit are known. One known pixel circuit corresponding to the former method is a pixel circuit configured to charge the holding capacitor with the data voltage via the drive transistor in a diode-connected state after initializing voltage at the gate terminal of the drive transistor, that is, the voltage held in the holding capacitor. In such a pixel circuit, variation and fluctuation of the threshold voltage in the drive transistor are compensated for within the pixel circuit (hereinafter, the compensation of variation and fluctuation of threshold voltage is referred to as "threshold compensation").

As described above, an item associated with an organic EL display device that employs a method of threshold compensation in a pixel circuit (hereinafter referred to as an "internal compensation method") is described in PTL 1 and 2. More specifically, in the pixel circuit of the light-emitting apparatus disclosed in PTL 1, the anode of a light-emitting element (organic EL element) is connected to the source of an N-channel drive transistor, the cathode of the light-emitting element is connected to the potential line of a low potential-side potential VCT, and a holding capacitor is interposed between the gate and the source of the drive transistor (FIG. 4). In this pixel circuit, during an initialization period before a compensation operation, the potentials of the gate and the source of the drive transistor are set to initialization potentials VINI1 and VINI2, respectively, such that a voltage VGS between the gate and the source of the drive transistor is larger than a threshold voltage VTH of the drive transistor and smaller than a threshold voltage VTH_E of the light-emitting element (such that the drive transistor is controlled to an on state and the light-emitting element is controlled to a non-light emitting state) (see paragraphs [0028] and [0029]).

In the organic EL device described in PTL 2, the drain of a P-channel drive transistor is connected to a pixel electrode (anode) of an organic EL element via a light emission control transistor, the potential line of a low-power supply potential VCT is connected to the counter electrode (cathode) of the organic EL element, and a capacitor is interposed between the gate and the source of the drive transistor. Further, a transistor is disposed as a switching element between the gate and the drain of the drive transistor, and a discharge control transistor is disposed between the drain and a supply line 115 (FIG. 10). This pixel circuit is configured such that, when initializing the gate potential Vg of the drive transistor, a potential VX[i]=VH higher than the potential (GND) applied to the drain of the drive transistor for discharging the accumulated charge in the drain or the accumulated charge in the parasitic capacitance of the organic EL element is applied to the gate of the drive transistor (FIG. 11). This is to reduce the current flowing in the supply line 115 via the drive transistor and the discharge transistor during initialization while performing effective discharge (see paragraph [0062]).

CITATION LIST

Patent Literature

PTL 1: JP 2011-33678 A
PTL 2: JP 2010-262251 A

SUMMARY

Technical Problem

In an organic EL display device employing an internal compensation method, when the pixel circuit is configured as described above to write a data voltage to the holding capacitor via the drive transistor in a diode-connected state after initializing the voltage of the gate terminal of the drive transistor (corresponding to the holding voltage of the holding capacitor), a bright dot that is not included in the intended display content in the display image (hereinafter referred to as a "bright dot defect") may occur.

Because of this, there is a need to display a good-quality image with no bright dot defect in a current-driven display device such as an organic EL display device employing an internal compensation method.

Solution to Problem

A display device including a plurality of data signal lines, a plurality of scanning signal lines intersecting the plurality of data signal lines, a plurality of light emission control lines individually corresponding to the plurality of scanning signal lines, and a plurality of pixel circuits arranged in a matrix along the plurality of data signal lines and the plurality of scanning signal lines, the display device including:

first and second power source lines;

an initialization voltage supply circuit;

a data signal line drive circuit configured to drive the plurality of data signal lines;

a scanning signal line drive circuit configured to selectively drive the plurality of scanning signal lines; and a light emission control circuit configured to drive the plurality of light emission control lines, each pixel circuit including:

a display element driven by a current;

a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and first and second initialization switching elements, in which a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, the second conduction terminal via the threshold compensation switching element, and a first conduction terminal of the first initialization switching element, the first terminal of the display element is connected to a first conduction terminal of the second initialization switching element, and a second terminal of the display element is connected to the second power source line, the first initialization switching element is controlled to an on state when a holding voltage of the holding capacitor is to be initialized, the second initialization switching element is controlled to an on state when the first terminal of the display element is to be initialized, and the first initialization transistor is controlled to an off state when the display element is to be driven based on the holding voltage of the holding capacitor, in the initialization voltage supply circuit, a first initialization voltage is supplied to a second conduction terminal of the first initialization switching element when the holding voltage of the holding capacitor is to be initialized, and a second initialization voltage is supplied to a second conduction terminal of the second initialization switching element when the first terminal of the display element is to be initialized, and when the display element is to be driven based on the holding voltage of the holding capacitor, voltage is supplied to the second conduction terminal of the first initialization switching element such that an absolute value of a difference between a voltage of the second conduction terminal of the first initialization switching element and a voltage of the second power source line is larger than an absolute value of a difference between the second initialization voltage and a voltage of the second power source line.

A display device according to several other embodiments of the disclosure is a display device including a plurality of data signal lines, a plurality of scanning signal lines intersecting the plurality of data signal lines, a plurality of light emission control lines individually corresponding to the plurality of scanning signal lines, and a plurality of pixel circuits arranged in a matrix along the plurality of data signal lines and the plurality of scanning signal lines, the display device including:

first and second power source lines;

first and second initialization voltage lines;

a data signal line drive circuit configured to drive the plurality of data signal lines;

a scanning signal line drive circuit configured to selectively drive the plurality of scanning signal lines; and a light emission control circuit configured to drive the plurality of light emission control lines, each pixel circuit comprising:

a display element driven by a current;

a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and first and second initialization switching elements, in which a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, the second conduction terminal via the threshold compensation switching element, and the first initialization voltage line via the first initialization switching element, the first terminal of the display element is connected to the second initialization voltage line via the second initialization switching element, and a second terminal of the display element is connected to the second power source line, and the first initialization switching element is controlled to an on state when the holding voltage of the holding capacitor is to be initialized, and the second initialization switching element is controlled to an on state when the first terminal of the display element is to be initialized.

A method for driving a display device according to several other embodiments of the disclosure is a method for driving a display device including a plurality of data signal lines, a plurality of scanning signal lines intersecting the plurality of data signal lines, a plurality of light emission control lines individually corresponding to the plurality of scanning signal lines, first and second power source lines, and a plurality of pixel circuits arranged in a matrix along the plurality of data signal lines and the plurality of scanning signal lines, the method for driving a display device including:

supplying a voltage used for initialization to each pixel circuit, each pixel circuit comprising:

a display element driven by a current;

a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and first and second initialization switching elements, in which a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, the second conduction terminal via the threshold compensation switching element, and a first conduction terminal of the first initialization switching element, the first terminal of the display element is connected to a first conduction terminal of the second initialization switching element, and a second terminal of the display element is connected to the second power source line, the first initialization switching element is controlled to an on state when a holding voltage of the holding capacitor is to be initialized, the second initialization switching element is controlled to an on state when the first terminal of the display element is to be initialized, and the first initialization transistor is controlled to an off state when the display element is to be driven based on the holding voltage of the holding capacitor, the initialization voltage supply step includes:

supplying a first initialization voltage to a second conduction terminal of the first initialization switching element when the holding voltage of the holding capacitor is to be initialized, supplying a second initialization voltage to a second conduction terminal of the second initialization switching element when the first terminal of the display element is to be initialized, and when the display element is to be driven based on the holding voltage of the holding capacitor, supplying voltage to the second conduction terminal of the first initialization switching element such that an absolute value of a difference between a voltage of the second conduction terminal of the first initialization switching element and a voltage of the second power source line is larger than an absolute value of a difference between the second initialization voltage and a voltage of the second power source line.

Advantageous Effects of Disclosure

In some of the above-described embodiments of the disclosure, the pixel circuit is configured such that voltage of the data signal line is applied to the holding capacitor as data voltage via the drive transistor put into a diode-connected state by the threshold compensation switching element, and the holding voltage of the holding capacitor is initialized before the data voltage is written in this way. To perform this initialization, the control terminal of the drive transistor (corresponding to one terminal of the holding capacitor) is connected to the first conduction terminal of the first initialization switching element, and the first initialization voltage is applied to the second conduction terminal. Further, in this pixel circuit, the voltage of the first terminal of the display element is initialized before the display element is driven according to the holding voltage of the holding capacitor (before the lighting operation). For this initialization, the first terminal of the display element is connected to the first conduction terminal of the second initialization switching element, and the second initialization voltage is applied to the second conduction terminal. On the other hand, during the lighting operation in which the display element is driven according to the holding voltage of the holding capacitor, that is, in a light emission period, voltage is supplied to the second conduction terminal of the first initialization switching element such that an absolute value of a difference between the voltage of the second conduction terminal and the voltage of the second power source line is larger than an absolute value of a difference between the second initialization voltage and the voltage of the second power source line. Thus, compared to a known pixel circuit in which a voltage corresponding to the second initialization voltage is fixedly applied to the second conduction terminals of both the first and second initialization switching elements, less voltage is applied between the first conduction terminal and the second conduction terminal of the first initialization switching element in the off state during the light emission period. This reduces leakage current of the first initialization switching element in the off state connected to the control terminal of the drive transistor (one terminal of the holding capacitor). Because of this, it is possible to reduce a voltage drop at the control terminal of the drive transistor caused by leakage current of the transistor in the off state during the light emission period without increasing the size of the first initialization switching element. Thus, it is possible to provide a pixel circuit that has a threshold compensation function and in which no bright dot defect (a bright dot not included in the intended display content) occurs due to leakage current.

In some other embodiments of the disclosure, in a pixel circuit including a threshold compensation function similar to that described above, the control terminal of the drive transistor is connected to the first conduction terminal of the first initialization switching element for initialization of the holding voltage of the holding capacitor (initialization of the voltage of the control terminal of the drive transistor) performed before the data voltage is written. The first terminal of the display element is connected to the first conduction terminal of the second initialization switching element to initialize the voltage of the first terminal of the display element before the display element is to be driven according to the holding voltage of the holding capacitor (prior to the lighting operation). In some other embodiments, the first initialization voltage line is connected to the second conduction terminal of the first initialization switching element, and the second initialization voltage line is connected to the second conduction terminal of the second initialization switching element. Because of this, an initialization voltage different from the initialization voltage to be applied to the first terminal of the display element can be fixedly applied to the control terminal of the drive transistor. Thus, compared to a known pixel circuit in which a voltage corresponding to the second initialization voltage is fixedly applied to the second conduction terminals of both the first and second initialization switching elements, less voltage is applied between the first conduction terminal and the second conduction terminal of the first initialization switching element in the off state during the light emission period. Thus, the other embodiments described above can also achieve a similar effect to the embodiments described above because it is possible to reduce a voltage drop at the control terminal of the drive transistor caused by leakage current of the transistor in the off state during the light emission period without increasing the size of the first initialization switching element.

BRIEF DESCRIPTION OF DRAWINGS

FIG. 6(A) illustrates a reset operation of the pixel circuit according to the first embodiment, FIG. 6(B) illustrates a data write operation of the pixel circuit, and FIG. 6(C) illustrates a lighting operation of the pixel circuit.

DESCRIPTION OF EMBODIMENTS

In the following, each embodiment will be described with reference to the accompanying drawings. Note that in each of the transistors referred to below, the gate terminal corresponds to a control terminal, one of the drain terminal and the source terminal corresponds to a first conduction terminal, and the other corresponds to a second conduction terminal. All the transistors in each embodiment are described as P-channel transistors, but the disclosure is not limited thereto. Furthermore, the transistor in each embodiment is, for example, a thin film transistor, but the disclosure is not limited thereto. Still further, the term "connection" used herein means "electrical connection" unless otherwise specified, and without departing from the spirit and scope of the disclosure, the term includes not only a case in which direct connection is meant but also a case in which indirect connection with another element therebetween is meant.

1. First Embodiment

1.1 Overall Configuration

Figure 1:
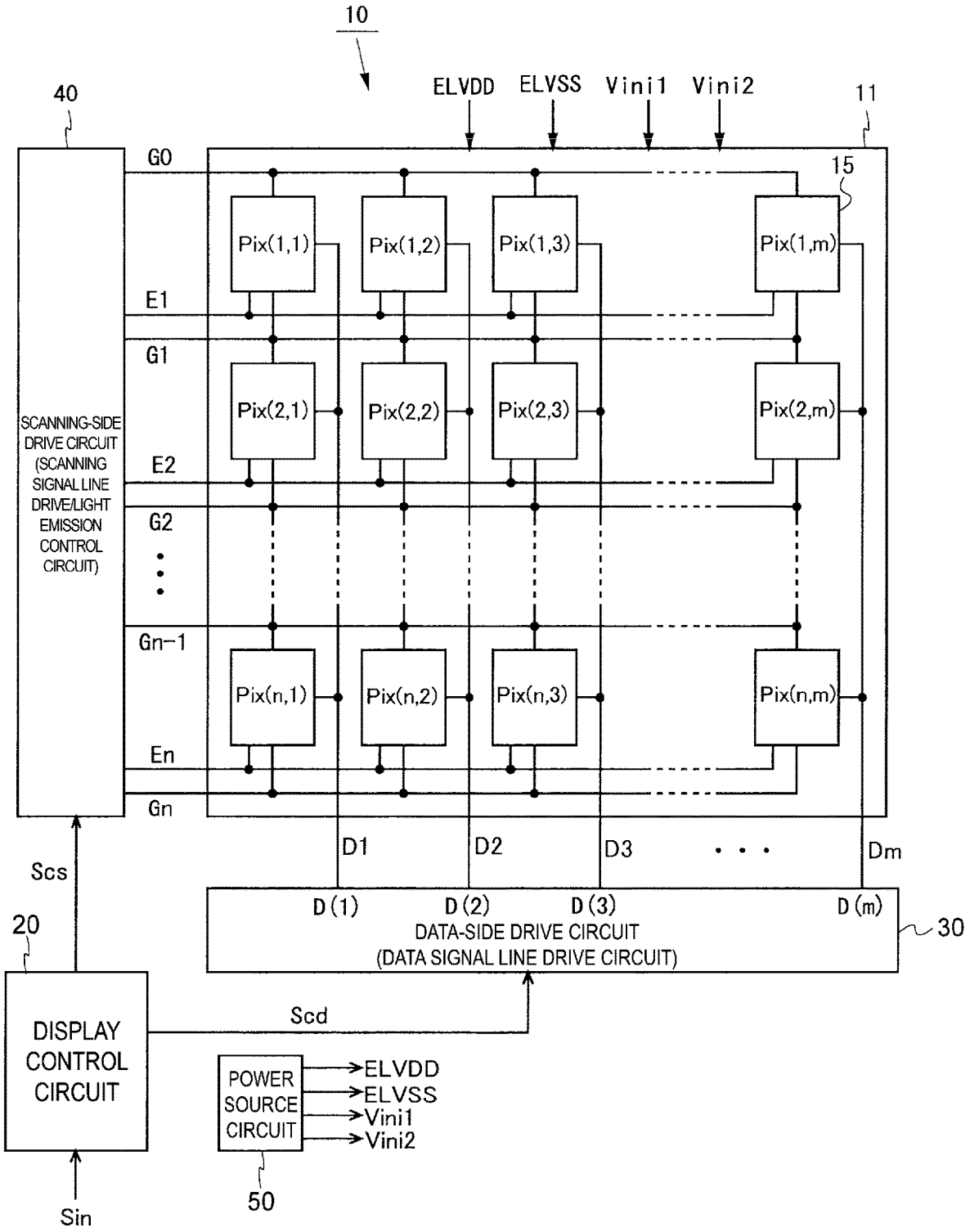
FIG. 1 is a block diagram illustrating an overall configuration of a display device according to a first embodiment.

FIG. 1 is a block diagram illustrating an overall configuration of an organic EL display device 10 according to a first embodiment. The display device 10 is an organic EL display device that performs internal compensation. That is, when pixel data is written to each pixel circuit in the display device 10, a holding capacitor is charged with voltage of a data signal (data voltage) via a drive transistor in a diode-connected state in each pixel circuit to compensate for variations and fluctuations in the threshold voltage of the drive transistor (details described later).

As illustrated in FIG. 1, the display device 10 includes a display portion 11, a display control circuit 20, a data-side drive circuit 30, a scanning-side drive circuit 40, and a power source circuit 50. The data-side drive circuit 30 functions as a data signal line drive circuit (also referred to as a "data driver"). The scanning-side drive circuit 40 functions as a scanning signal line drive circuit (also referred to as a "gate driver") and a light emission control circuit (also referred to as an "emission driver"). The two drive circuits are configured as one scanning-side drive circuit 40 in the configuration illustrated in FIG. 1, but a configuration where the two drive circuits are separated as needed in the scanning-side drive circuit 40, or a configuration where the two drive circuits are disposed separately on different sides of the display portion 11 may be adopted. Additionally, the scanning-side drive circuit may be integrally formed with the display portion 11. The same applies to subsequent embodiments and modification examples. The power source circuit 50 generates a high-level power supply voltage ELVDD, a low-level power supply voltage ELVSS, a first initialization voltage Vini1, and a second initialization voltage Vini2, which are described below, to be supplied to the display portion 11, and power supply voltages (not illustrated) to be supplied to the display control circuit 20, the data-side drive circuit 30, and the scanning-side drive circuit 40.

The display portion 11 is provided with m (m is an integer of 2 or greater) data signal lines D1 to Dm and n+1 (n is an integer of 2 or greater) scanning signal lines G0 to Gn that intersect the data signal lines D1 to Dm, and n light emission control lines (also referred to as "emission lines") E1 to En disposed along the n scanning signal lines G1 to Gn, respectively. As illustrated in FIG. 1, the display portion 11 is provided with m×n pixel circuits 15. The m×n pixel circuits 15 are arranged in a matrix along the m data signal lines D1 to Dm and the n scanning signal lines G1 to Gn. Each pixel circuit 15 corresponds to any one of the m data signal lines D1 to Dm and to any one of the n scanning signal lines G1 to Gn (hereinafter, when distinguishing between each pixel circuit 15, a pixel circuit corresponding to an ith scanning signal line Gi and a jth data signal line Dj will also be referred to as an "ith row, jth column pixel circuit", and will be denoted by the reference sign "Pix(i, j)"). The n light emission control lines E1 to En correspond to the n scanning signal lines G1 to Gn, respectively. Accordingly, each pixel circuit 15 also corresponds to any one of the n light emission control lines E1 to En.

The display portion 11 is also provided with a power source line (not illustrated) common to each pixel circuit 15. In other words, a power source line (hereinafter, referred to as a "high-level power source line" and designated by the reference sign "ELVDD" similar to the high-level power supply voltage) used for supplying the high-level power supply voltage ELVDD for driving the organic EL element described later, and a power source line (hereinafter, referred to as a "low-level power source line" and designated by the reference sign "ELVSS" similar to the low-level power supply voltage) used for supplying the low-level power supply voltage ELVSS for driving the organic EL element are provided. The display portion 11 also includes first and second initialization voltage lines (not illustrated and denoted by the reference signs "Vini1" and "Vini2" similar to the first and second initialization voltages, respectively) used for supplying the first and second initialization voltages Vini1 and Vini2, which are two fixed voltages used in a reset operation for initializing each pixel circuit 15 (details described later). The high-level power supply voltage ELVDD, the low-level power supply voltage ELVSS, and the first and second initialization voltages Vini1 and Vini2 are supplied from the power source circuit 50 illustrated in FIG. 1. In the present embodiment, the first and second initialization voltage lines Vini1 and Vini2 and the power source circuit 50 form an initialization voltage supply circuit.

The display control circuit 20 receives an input signal Sin including image information representing an image to be display and timing control information for image display from outside of the display device 10 and, based on the input signal Sin, generates a data-side control signal Scd and a scanning-side control signal Scs, and outputs the data-side control signal Scd to the data-side drive circuit (data signal line drive circuit) 30 and outputs the scanning-side control signal Scs to the scanning-side drive circuit (scanning signal line drive/light emission control circuit) 40.

The data-side drive circuit 30 drives the data signal lines D1 to Dm based on the data-side control signal Scd output from the display control circuit 20. More specifically, the data-side drive circuit 30 outputs in parallel m data signals D(1) to D(m) representing an image to be displayed, and applies the data signals D(1) to D(m) to the data signal lines D1 to Dm, respectively, based on the data-side control signal Scd.

The scanning-side drive circuit 40 functions as a scanning signal line drive circuit that drives the scanning signal lines G0 to Gn and a light emission control circuit that drives the light emission control lines E1 to En based on the scanning-side control signal Scs output from the display control circuit 20. More specifically, when functioning as the scanning signal line drive circuit, the scanning-side drive circuit 40 sequentially selects the scanning signal lines G0 to Gm in individual frame periods based on the scanning-side control signal Scs, and applies an active signal (low-level voltage) to a selected scanning signal line Gk and an inactive signal (high-level voltage) to the unselected scanning signal lines. With this, m pixel circuits Pix(k, 1) to Pix(k, m) corresponding to the selected scanning signal line Gk ($1 \leq k \leq n$) are collectively selected. As a result, in the select period of the scanning signal line Gk (hereinafter referred to as a "kth scanning select period"), the voltages of the m data signals D(1) to D(m) applied to the data signal lines D1 to Dm from the data-side drive circuit 30 (hereinafter also referred to as simply "data voltages" when not distinguished from each other) are written as pixel data to the pixel circuits Pix(k, 1) to Pix(k, m), respectively.

When functioning as the light emission control circuit, based on the scanning-side control signal Scs, the scanning-side drive circuit 40 applies a light emission control signal (high-level voltage) indicating non-light emission to an ith light emission control line Ei in an i-1th horizontal period and an ith horizontal period, and applies a light emission control signal (low-level voltage) indicating light emission to the ith light emission control line Ei in other periods. Organic EL elements in pixel circuits (hereinafter also referred to as "ith row pixel circuits") Pix(i, 1) to Pix(i, m) corresponding to the ith scanning signal line Gi emit light at luminance corresponding to the data voltages written to the ith row pixel circuits Pix(i, 1) to Pix(i, m), respectively, while the voltage of the light emission control line Ei is at a low level.

1.2 Configuration and Operation of Pixel Circuit in Known Example

Prior to describing the configuration and operation of the pixel circuit 15 in the present embodiment, the configuration and operation of a pixel circuit 15*a* in a known organic EL display device (hereinafter referred to as a "known example") as a pixel circuit for comparison with the pixel circuit 15 will be described with reference to FIGS. 2 and 3. Note that, in the known example, unlike the configuration illustrated in FIG. 1, an initialization voltage line Vini is provided in place of the first and second initialization voltage lines Vini1 and Vini2 in the display portion 11, and an initialization voltage Vini, which is a fixed voltage, is supplied to the initialization voltage line Vini from the power source circuit 50. However, other components in the overall configuration of the known example are the same as those illustrated in FIG. 1.

Figure 2:
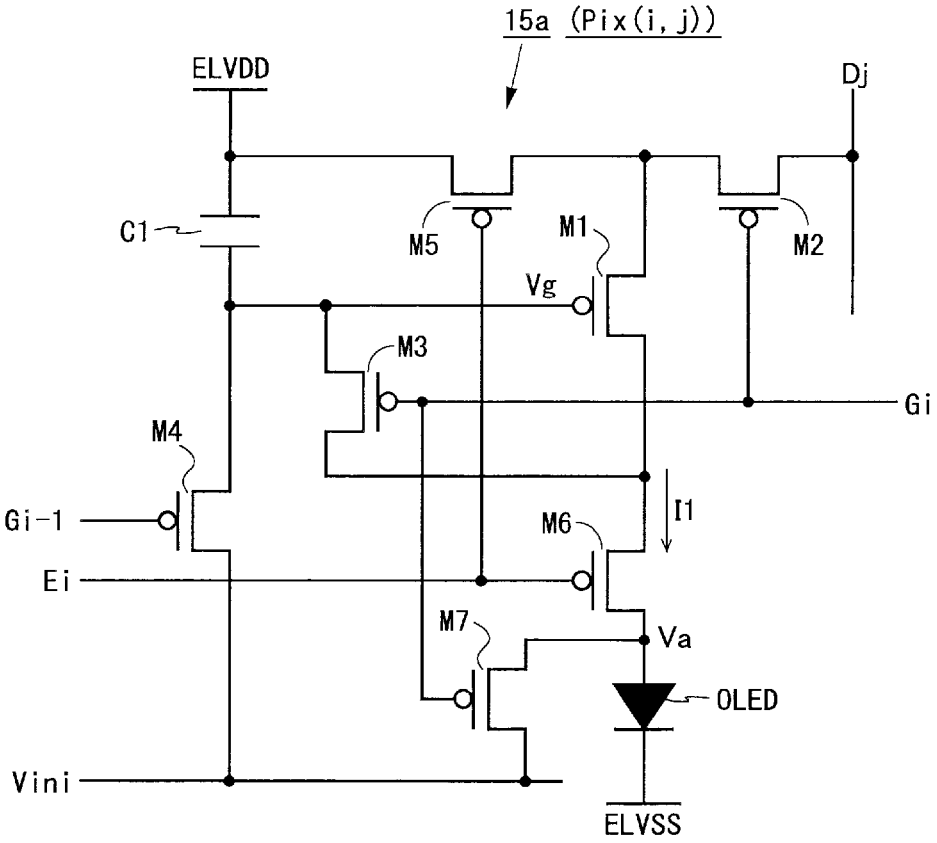
FIG. 2 is a circuit diagram illustrating a configuration of a pixel circuit in a known display device.

FIG. 2 is a circuit diagram illustrating a configuration of the pixel circuit 15*a* in the known example, and more specifically, a pixel circuit 15*a* corresponding to the ith scanning signal line Gi and the jth data signal line Dj, i.e., a pixel circuit representing the configuration of the ith row, jth column pixel circuit Pix(i, j) ($1 \leq i \leq n$, $1 \leq j \leq m$). As illustrated in FIG. 2, the pixel circuit 15*a* includes an organic EL element OLED as a display element, a drive transistor M1, a write control transistor M2, a threshold compensation transistor M3, a first initialization transistor M4, a first light emission control transistor M5, a second light emission control transistor M6, a second initialization transistor M7, and a holding capacitor C1. In the pixel circuit 15*a*, the transistors M2 to M7 other than the drive transistor M1 function as switching elements.

In the pixel circuit 15*a*, a scanning signal line corresponding to the pixel circuit 15*a* (hereinafter also referred to as a "corresponding scanning signal line" in the description focusing on the pixel circuit) Gi, a scanning signal line immediately before the corresponding scanning signal line Gi (a scanning signal line immediately before the scanning signal lines G1 to Gn in scanning order, hereinafter also referred to as a "preceding scanning signal line" in the description focusing on the pixel circuit) Gi−1, a light emission control line corresponding to the preceding scanning signal line (hereinafter also referred to as a "corresponding light emission control line" in the description focusing on the pixel circuit) Ei, a data signal line corresponding to the corresponding light emission control line Ei (hereinafter also referred to as a "corresponding data signal line" in the description focusing on the pixel circuit) Dj, the initialization voltage line Vini, the high-level power source line ELVDD, and the low-level power source line ELVSS are connected to each other.

As illustrated in FIG. 2, in the pixel circuit 15*a*, a source terminal of the drive transistor M1 is connected to the corresponding data signal line Dj via the write control transistor M2 and to the high-level power source line ELVDD via the first light emission control transistor M5. A drain terminal of the drive transistor M1 is connected to an anode electrode of the organic EL element OLED via the second light emission control transistor M6. A gate terminal of the drive transistor M1 is connected to the high-level power source line ELVDD via the holding capacitor C1, connected to a drain terminal of the drive transistor M1 via the threshold compensation transistor M3, and connected to the initialization voltage line Vini via the first initialization transistor M4. The anode electrode of the organic EL element OLED is connected to the initialization voltage line Vini via the second initialization transistor M7, and a cathode electrode of the organic EL element OLED is connected to the low-level power source line ELVSS. Gate terminals of the write control transistor M2, the threshold compensation transistor M3, and the second initialization transistor M7 are connected to the corresponding scanning signal line Gi, gate terminals of the first and second light emission control transistors M5 and M6 are connected to the corresponding light emission control line Ei, and a gate terminal of the first initialization transistor M4 is connected to the preceding scanning signal line Gi−1.

The drive transistor M1 operates in a saturation region. A drive current I1 flowing through the organic EL element OLED in the light emission period is given by Equation (1) below. A gain β of the drive transistor M1 included in Equation (1) is given by Equation (2) below.

$$I1=(\beta/2)(|Vgs|-|Vth|)^2=(\beta/2)(|Vg-ELVDD|-|Vth|)^2 \quad (1)$$

$$\beta=\mu\times(W/L)\times Cox \quad (2)$$

In Equations (1) and (2), Vth, μ, W, L, and Cox represent the threshold voltage, mobility, gate width, gate length, and gate insulating film capacitance per unit area of the drive transistor M1, respectively.

Figure 3:
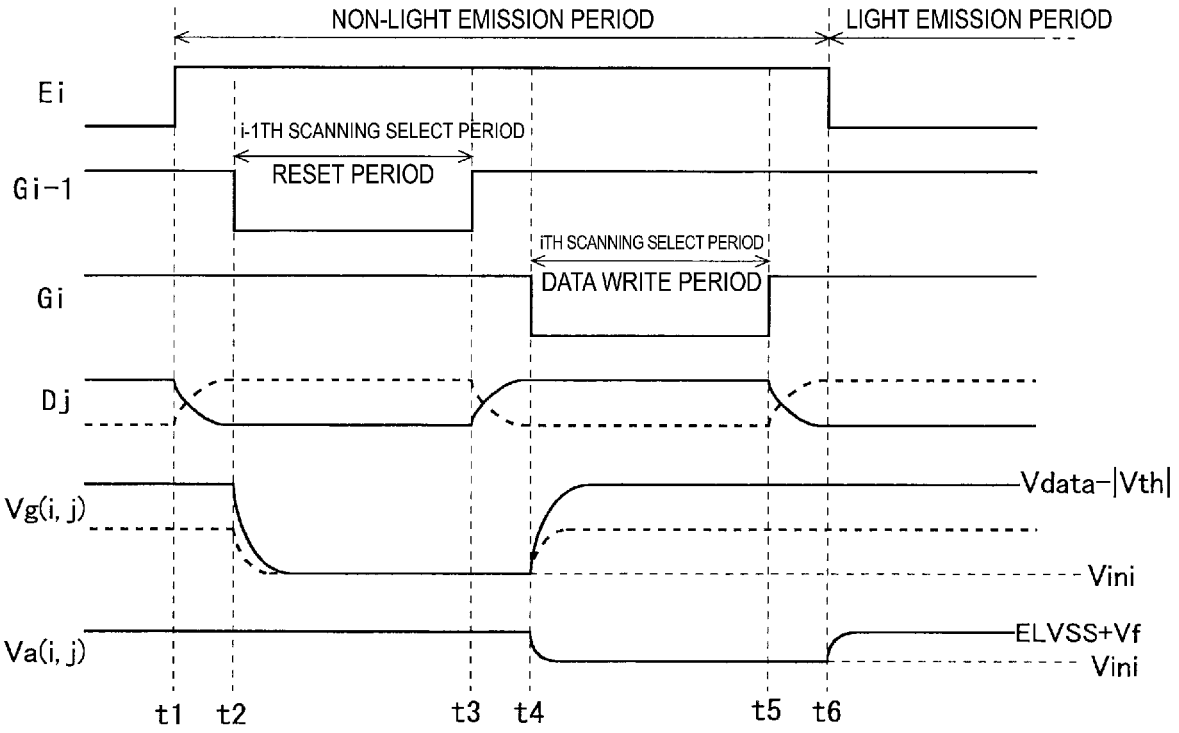
FIG. 3 is a signal waveform diagram for explaining drive of the known display device.

FIG. 3 is a signal waveform diagram for explaining drive of the display device according to the known example, and illustrates fluctuation in the voltages of the signal lines (corresponding light emission control line Ei, preceding scanning signal line Gi−1, corresponding scanning signal line Gi, and corresponding data signal line Dj) in the initialization operation, the reset operation, and the lighting operation of the pixel circuit 15*a* illustrated in FIG. 2, i.e., the ith row, jth column pixel circuit Pix(i, j), a voltage of the gate terminal of the drive transistor M1 (hereinafter referred to as "gate voltage") Vg, and a voltage of the anode electrode of the organic EL element OLED (hereinafter referred to as "anode voltage") Va. In FIG. 3, the period from the time t1 to the time t6 represents the non-light emission period of the ith row pixel circuits Pix(i, 1) to Pix(i, m). The period from the time t2 to the time t4 is the i-1th horizontal period, and the period from the time t2 to the time t3 is the select period of the i-1th scanning signal line (preceding scanning signal line) Gi−1 (hereinafter referred to as an "i-1th scanning select period"). The i-1th scanning select period corresponds to a reset period of the ith row pixel circuits Pix(i, 1) to Pix (i, m). The period from the time t4 to the time t6 is the ith horizontal period, and the period from the time t4 to the time t5 is the select period of the ith scanning signal line (corresponding scanning signal line) Gi (hereinafter referred to as "ith scanning select period"). The ith scanning select period corresponds to a data write period of the ith row pixel circuits Pix(i, 1) to Pix(i, m).

In the ith row, jth column pixel circuit Pix(i, j), when the voltage of the light emission control line Ei changes from the low level to the high level at the time t1 as illustrated in FIG. 3, the first and second light emission control transistors M5 and M6 change from the on state to the off state, and the organic EL element OLED enters a non-light emission state. During the period from the time t1 to the start time t2 of the i-1th scanning select period, the data-side drive circuit 30 starts to apply the data signal D(j) to the data signal line Dj as the data voltage of the i-1th row, jth column pixel, and, in the pixel circuit Pix(i, j), the write control transistor M2 connected to the data signal line Dj is in an off state.

At the time t2, the voltage of the preceding scanning signal line Gi−1 changes from the high level to the low level, which causes the preceding scanning signal line Gi−1 to enter a select state. Due to this change, the first initialization transistor M4 enters an on state. Thus, the voltage of the gate terminal of the drive transistor M1, i.e., the gate voltage Vg is initialized to the initialization voltage Vini. The initialization voltage Vini is such a voltage that the voltage can keep the drive transistor M1 in an on state during the writing of the data voltage to the pixel circuit Pix(i, j). More specifically, the initialization voltage Vini satisfies Equation (3) below.

$$|Vini-Vdata|>|Vth| \quad (3),$$

where Vdata represents the data voltage (voltage of the corresponding data signal line Dj), and Vth represents the threshold voltage of the drive transistor M1. Further, because the drive transistor M1 in the present embodiment is a P-channel transistor, $$Vini<Vdata \quad (4).$$

By initializing the gate voltage Vg to the initialization voltage Vini in such a way, the data voltage can be reliably written to the pixel circuit Pix(i, j). Note that the initialization of the gate voltage Vg is also the initialization of the holding voltage of the holding capacitor C1.

The period from the time t2 to the time t3 is a reset period in the ith row pixel circuits Pix(i, 1) to Pix(i, m). In the pixel circuit Pix(i, j), the gate voltage Vg is initialized by the first initialization transistor M4 being in the on state in the reset period as described above. FIG. 3 illustrates a change in a gate voltage Vg(i, j) in the pixel circuit Pix(i, j) at this time. Note that the reference sign "Vg(i, j)" is used to differentiate the gate voltage Vg in the pixel circuit Pix(i, j) from the gate voltage Vg in other pixel circuits (the same applies hereinafter).

At the time t3, the voltage of the preceding scanning signal line Gi−1 changes to the high level, which causes the preceding scanning signal line Gi−1 to enter a non-select state. Therefore, the first initialization transistor M4 changes to an off state. During the period from the time t3 to the start time t4 of the ith scanning select period, the data-side drive circuit 30 starts to apply the data signal D(j) to the data signal line Dj as the data voltage of the ith row, jth column pixel, and continues to apply the data signal D(j) at least until the end time t5 of the ith scanning select period.

At the time t4, the voltage of the corresponding scanning signal line Gi changes from the high level to the low level, which causes the corresponding scanning signal line Gi to enter a select state. Because of this, the write control transistor M2 changes to the on state. The threshold compensation transistor M3 also changes to the on state, and hence the drive transistor M1 is in a state in which the gate terminal and the drain terminal of the drive transistor M1 are connected, i.e., in a diode-connected state. As a result, the voltage of the corresponding data signal line Dj, i.e., the voltage of the data signal D(j) is applied to the holding capacitor C1 as the data voltage Vdata via the drive transistor M1 in the diode-connected state. As a result, as illustrated in FIG. 3, the gate voltage Vg(i, j) changes toward the value given by Equation (5) below.

$$Vg(i,j)=Vdata-|Vth| \quad (5)$$

At the time t4, the voltage of the corresponding scanning signal line Gi changes from the high level to the low level, which causes the second initialization transistor M7 to change to the on state. As a result, accumulated charge in the parasitic capacitance of the organic EL element OLED is discharged and the anode voltage Va of the organic EL element is initialized to the initialization voltage Vini (see FIG. 3). Note that the reference sign "Va(i, j)" is used to differentiate the anode voltage Va in the pixel circuit Pix(i, j) from the anode voltage Va in other pixel circuits (the same applies hereinafter).

The period from the time t4 to the time t5 is a data write period in the ith row pixel circuits Pix(i, 1) to Pix(i, m). In the pixel circuit Pix(i, j), a data voltage that has undergone threshold compensation is written to the holding capacitor C1 in the data write period, and the gate voltage Vg(i, j) is the value given by Equation (5) above.

Then, at the time t6, the voltage of the light emission control line Ei changes to a low level. Accordingly, the first and second light emission control transistors M5 and M6 change to the on state. Thus, after the time t6, the current I1 flows from the high-level power source line ELVDD to the low-level power source line ELVSS via the first light emission control transistor M5, the drive transistor M1, the second light emission control transistor M6, and the organic EL element OLED. This current I1 is given by Equation (1) above. Considering that the drive transistor M1 is a P-channel transistor and ELVDD>Vg, the current I1 is given by Equations (1) and (5) above.

$$I1 = (\beta/2)(ELVDD - Vg - |Vth|)^2 = (\beta/2)(ELVDD - Vdata)^2 \quad (6)$$

As described above, after the time t6, the organic EL element OLED emits light at a luminance corresponding to the data voltage Vdata, which is the voltage of the corresponding data signal line Dj in an ith scanning select period, regardless of the threshold voltage Vth of the drive transistor M1.

1.3 Problems in Known Example

As described above, a display device such as that in the known example described above, i.e., a display device employing a pixel circuit configured to write a data voltage to a holding capacitor via a drive transistor in a diode-connected state after initializing the gate voltage of the drive transistor has a problem in that a bright dot defect occurs in the display image. The present inventors studied the operation of the pixel circuit 15*a* in the known example to find the cause of the bright dot defect. Now, the results of this study will be described.

In the pixel circuit 15*a* (Pix(i, j)) in the known example described above, the voltage of the corresponding data signal line Dj is applied to the holding capacitor C1 as the data voltage Vdata via the drive transistor M1 in the diode-connected state, thereby compensating for variation and fluctuation in the threshold voltage Vth of the drive transistor M1. In a pixel circuit employing such an internal compensation method, initialization of the gate voltage Vg of the drive transistor M1, i.e., initialization of the holding voltage of the holding capacitor C1, needs to be performed before the data write operation. Thus, as illustrated in FIG. 2, in the known example described above, the gate terminal of the drive transistor M1 is connected to the initialization voltage line Vini via the first initialization transistor M4.

When the pixel circuit 15*a* in the known example is to create a black display, in the data write period, a high voltage near the high-level power supply voltage ELVDD is applied to the gate terminal of the drive transistor M1 as the data voltage Vdata via the drive transistor M1 in the diode-connected state, and, in the light emission period, the gate voltage Vg is maintained at the high voltage by the holding capacitor C1. Thus, in the light emission period, a relatively high voltage (e.g., approximately 8 V) is continuously applied between the source and drain of the first initialization transistor M4 in the off state. As a result, leakage current may occur in the first initialization transistor M4, which may cause the gate voltage Vg to drop. If this occurs, an amount of current that does not correspond to the value of the written data voltage flows to the drive transistor M1 and the organic EL element OLED, and this generates a bright dot (bright dot defect) not included in the intended display content. A bright dot defect is particularly likely to occur when the off resistance of the first initialization transistor M4 decreases or the threshold voltage (absolute value) of the drive transistor M1 decreases due to manufacturing variation.

Using a transistor with a multi-gate structure, a transistor having a long channel length, or two transistors connected to each other in series as the first initialization transistor M4 has also been considered to minimize the occurrence of a bright dot defect. However, using such transistors increases the size of the first initialization transistor M4 and makes it difficult to achieve compact a pixel circuit.

1.4 Configuration and Operation of Pixel Circuit in Present Embodiment

Figure 4:
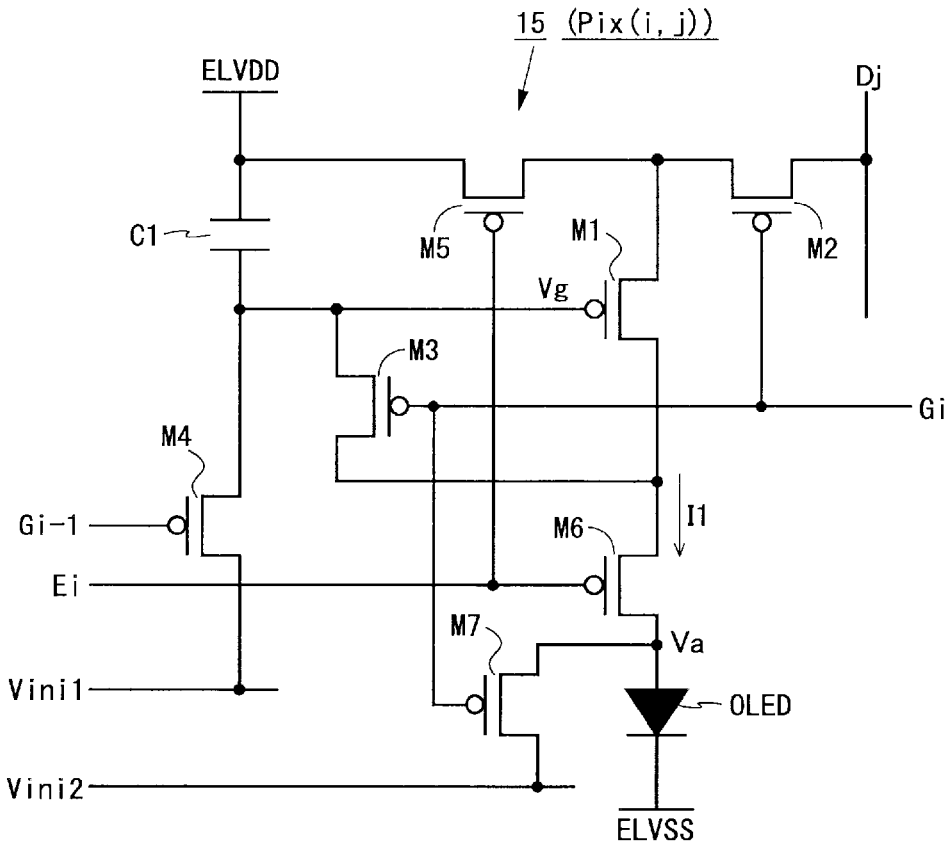
FIG. 4 is a circuit diagram illustrating a configuration of a pixel circuit according to the first embodiment.
Figure 5:
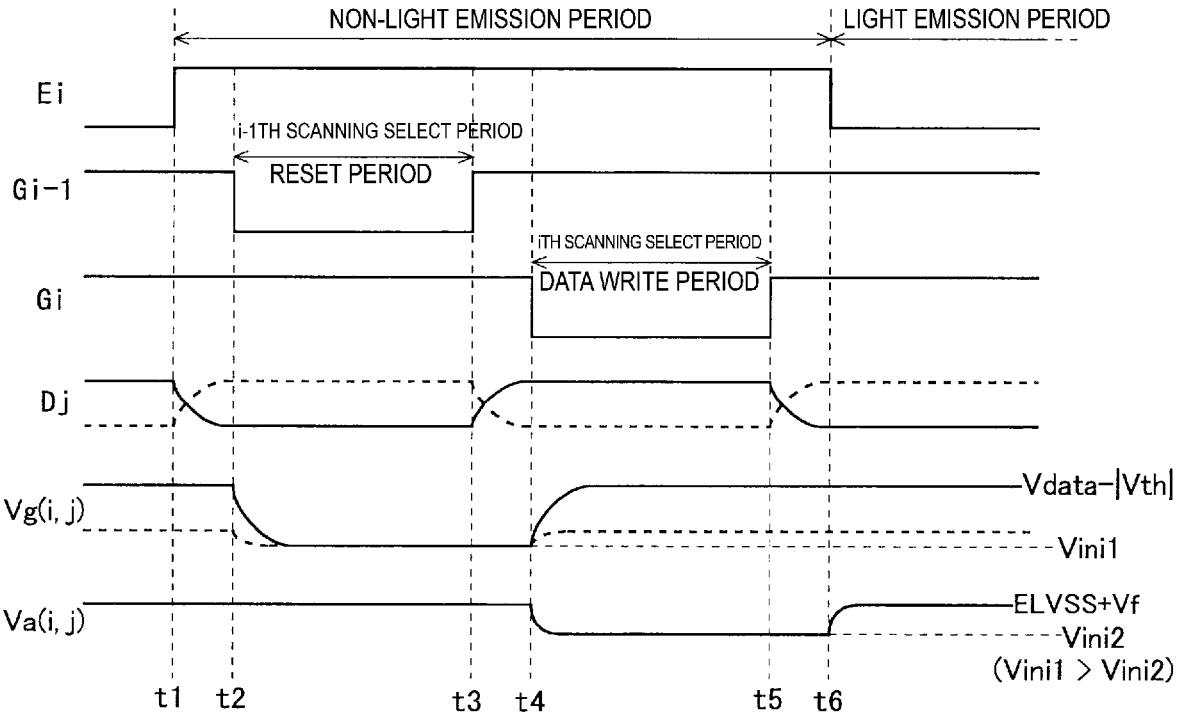
FIG. 5 is a signal waveform diagram for explaining drive of the display device according to the first embodiment.
Figure 6:
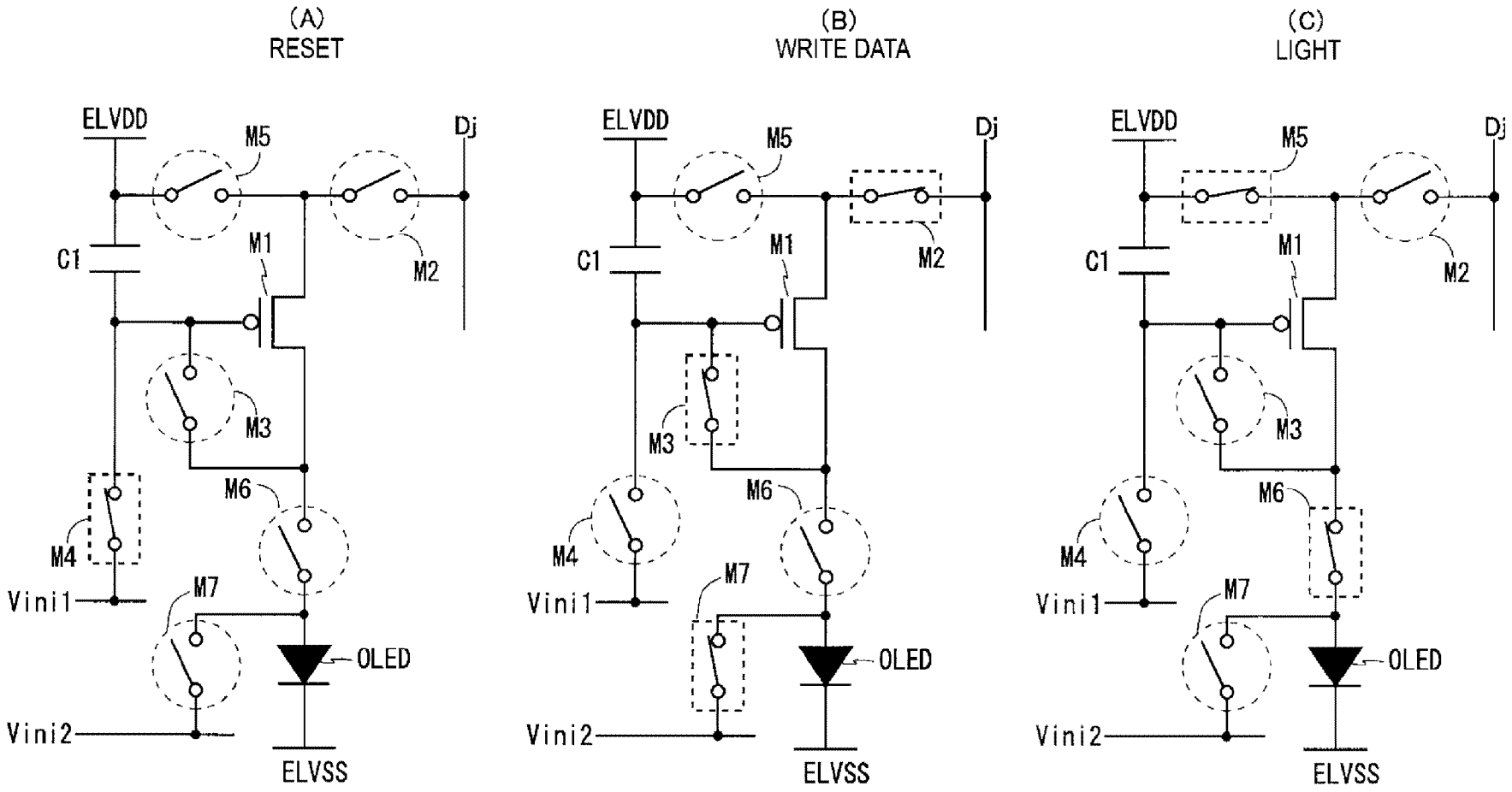
FIGS. 6(A) to 6(C) are circuit diagrams, where

Next, the configuration and operation of the pixel circuit 15 in the present embodiment will be described with reference to FIGS. 4 to 6. FIG. 4 is a circuit diagram illustrating a configuration of the pixel circuit 15 in the present embodiment. FIG. 5 is a signal waveform diagram for explaining drive of the organic EL display device 10 in the present embodiment. FIG. 6(A) is a circuit diagram illustrating a reset operation of the pixel circuit 15 in the present embodiment, FIG. 6(B) is a circuit diagram illustrating a data write operation of the pixel circuit 15, and FIG. 6(C) is a circuit diagram illustrating a lighting operation of the pixel circuit 15.

FIG. 4 illustrates a configuration of a pixel circuit 15 that corresponds to the ith scanning signal line Gi and the jth data signal line Dj in the present embodiment, i.e., an ith row, jth column pixel circuit Pix(i, j) ($1 \leq i \leq n$, $1 \leq j \leq m$). Similar to the pixel circuit 15*a* (FIG. 2) in the known example described above, the pixel circuit 15 includes the organic EL element OLED as a display element, the drive transistor M1, the write control transistor M2, the threshold compensation transistor M3, the first initialization transistor M4, the first light emission control transistor M5, the second light emission control transistor M6, the second initialization transistor M7, and the holding capacitor C1. As above, in the pixel circuit 15, the transistors M2 to M7 other than the drive transistor M1 function as switching elements.

As illustrated in FIG. 1, in the pixel circuit 15, a scanning signal line (corresponding scanning signal line) Gi corresponding to the pixel circuit 15, a scanning signal line (preceding scanning signal line) Gi−1 immediately before the corresponding scanning signal line Gi, a light emission control line (corresponding light emission control line) Ei corresponding to the preceding scanning signal line Gi−1, a data signal line (corresponding data signal line) Dj corresponding to the corresponding light emission control line Ei, a first initialization voltage line Vini1, a second initialization voltage line Vini2, a high-level power source line ELVDD, and a low-level power source line ELVSS are connected to each other.

As illustrated in FIG. 4, in the pixel circuit 15, similar to the pixel circuit 15*a* (FIG. 2) in the known example, a source terminal serving as a first conduction terminal of the drive transistor M1 is connected to the corresponding data signal line Dj via the write control transistor M2 and to the high-level power source line ELVDD via the first light emission control transistor M5. A drain terminal serving as a second conduction terminal of the drive transistor M1 is connected to an anode electrode serving as a first terminal of the organic EL element OLED via the second light emission control transistor M6. The gate terminal of the drive transistor M1 is connected to the high-level power source line ELVDD via the holding capacitor C1, the drain terminal of the drive transistor M1 via the threshold compensation transistor M3, and the first initialization voltage line Vini1 via the first initialization transistor M4. An anode electrode serving as a first terminal of the organic EL element OLED is connected to the second initialization voltage line Vini2 via the second initialization transistor M7. A cathode electrode serving as a second terminal of the organic EL element OLED is connected to the low-level power source line ELVSS. Gate terminals of the write control transistor M2, the threshold compensation transistor M3, and the second initialization transistor M7 are connected to the corresponding scanning signal line Gi. Gate terminals of the first and second light emission control transistors M5 and M6 are connected to the corresponding light emission control line Ei. A gate terminal of the first initialization transistor M4 is connected to the preceding scanning signal line Gi−1. As illustrated in FIG. 4, the pixel circuit 15 of the present embodiment differs from the pixel circuit 15*a* of the known example in which the drain terminals of the first and second initialization transistors M4 and M7 are connected to one initialization voltage line Vini, in that the drain terminal serving as the second conduction terminal of the first initialization transistor M4 and the drain terminal serving as the second conduction terminal of the second initialization transistor M7 are connected to the first and second initialization voltage lines Vini1 and Vini2, respectively. Note that, in the light emission period, the drive current I1 flowing through the organic EL element OLED in the pixel circuit 15 is given by Equation (1) above, similar to the pixel circuit 15*a* in the known example.

FIG. 5 illustrates fluctuation in the voltages of signal lines (corresponding light emission control line Ei, preceding scanning signal line Gi−1, corresponding scanning signal line Gi, and corresponding data signal line Dj) in the initialization operation, the reset operation, and the lighting operation of the pixel circuit 15 illustrated in FIG. 4, i.e., the ith row, jth column pixel circuit Pix(i, j), the gate voltage Vg of the drive transistor M1, and the anode voltage Va of the organic EL element OLED. In FIG. 5, similar to the known example described above (see FIG. 3), the period from the time t1 to the time t6 is a non-light emission period of the ith row pixel circuits Pix(i, 1) to Pix(i, m). The period from the time t2 to the time t4 is the i-1th horizontal period, and the period from the time t2 to the time t3 is the select period of the i-1th scanning signal line (preceding scanning signal line) Gi−1, i.e., the i-1th scanning select period. The i-1th scanning select period corresponds to a reset period of the ith row pixel circuits Pix(i, 1) to Pix(i, m), i.e., a period for initialization of the gate voltage Vg (initialization of the holding voltage of the holding capacitor C1). The period from the time t4 to the time t6 is the ith horizontal period, and the period from the time t4 to the time t5 is the select period of the ith scanning signal line (corresponding scanning signal line) Gi, i.e., the ith scanning select period. The ith scanning select period corresponds to the data write period of the ith row pixel circuits Pix(i, 1) to Pix(i, m).

Also in the present embodiment, in the ith row, jth column pixel circuit Pix(i, j), when the voltage of the light emission control line Ei changes from the low level to the high level at the time t1 as illustrated in FIG. 5, the first and second light emission control transistors M5 and M6 change from the on state to the off state, and the organic EL element OLED enters a non-light emission state, similar to the known example described above. During the period from the time t1 to the start time t2 of the i-1th scanning select period, the data-side drive circuit 30 starts to apply the data signal D(j) to the data signal line Dj as the data voltage of an i-1th row, jth column pixel. In the pixel circuit Pix(i, j), the write control transistor M2 connected to the data signal line Dj is in an off state.

At the time t2, the voltage of the preceding scanning signal line Gi−1 changes from the high level to the low level, which causes the preceding scanning signal line Gi−1 to enter a select state. Therefore, the first initialization transistor M4 enters an on state.

The period from the time t2 to the time t3 is a reset period in the ith row pixel circuits Pix(i, 1) to Pix(i, m). FIG. 6(A) schematically illustrates the state of the pixel circuit Pix(i, j) in the reset period, i.e., the circuit state during the reset operation. In FIG. 6(A), the dotted circles indicate that the transistors serving as switching elements in the pixel circuit are in an off state and the dotted rectangles indicate that the transistors serving as switching elements in the pixel circuit are in an on state (such a representation is also employed in FIGS. 6(B) and 6(C)). As illustrated in FIG. 6(A), in the reset period, because the first initialization transistor M4 is in the on state, the initialization voltage line Vini is electrically connected to the gate terminal of the drive transistor M1 (one terminal of the holding capacitor C1) via the first initialization transistor M4. Thus, during the reset period, the first initialization voltage Vini1 is supplied from the first initialization voltage line Vini1 to the gate terminal of the drive transistor M1 via the first initialization transistor M4. As a result, the gate voltage Vg (holding voltage of the holding capacitor C1) of the drive transistor M1 is basically initialized in the same manner as in the known example described above (see Equations (3) and (4) above).

However, the initialization of the gate voltage Vg in the present embodiment differs from initialization in the known example in which the same initialization voltage Vini is applied to the gate terminal of the drive transistor M1 and the anode electrode of the organic EL element OLED, in that the voltage Vini1 different to the voltage Vini2 used to initialize the anode electrode of the organic EL element OLED is applied to the gate terminal of the drive transistor M1. In other words, in the present embodiment, initialization of the gate voltage Vg is performed by applying the voltage of the first initialization voltage line Vini1 to the gate terminal of the drive transistor M1 as the first initialization voltage Vini1 via the first initialization transistor M4 (see FIG. 6(A)), and the initialization of the anode voltage Va is performed by applying the voltage of the second initialization voltage line Vini2 to the anode electrode of the organic EL element OLED as the second initialization voltage Vini2 via the second initialization transistor M7 as described below (see FIG. 6(B)). Therefore, in the present embodiment, a fixed voltage higher than the second initialization voltage Vini2 used for the anode voltage Va of the organic EL element OLED is selected within a range in which the data voltage of the holding capacitor C1 can be written in the data write period described below (the data voltage is written via the drive transistor M1 in a diode-connected state) as the first initialization voltage Vini1 used for the gate voltage Vg. In other words, the value of the first initialization voltage Vini1 is selected to satisfy Equations (7) to (9) below. As the second initialization voltage Vini2, a relatively low fixed voltage is selected to sufficiently discharge the accumulated charge in the parasitic capacitance of the organic EL element OLED (typically, Vini2=ELVSS).

$$Vini1 > Vini2 \tag{7}$$

$$|Vini1 - Vdata| > |Vth| \tag{8}$$

$$Vini1 < Vdata \tag{9}$$

Note that Equations (7) to (9) above assume that the drive transistor M1 is a P-channel transistor. More generally, the first initialization voltage Vini1 is selected to satisfy Expressions (10) and (11) below. When the drive transistor M1 is a P-channel transistor, Vini1<Vdata, and when the drive transistor M1 is an N-channel transistor, Vini1>Vdata.

$$|Vini1 - ELVSS| > |Vini2 - ELVSS| \tag{10}$$

$$|Vini1 - Vdata| > |Vth| \tag{11}$$

Expression (10) above represents the condition that the first initialization voltage Vini1 should satisfy using the low-level power supply voltage ELVSS, but this condition may be indicated using the high-level power supply voltage ELVDD. In other words, Expression (12) below may be used instead of Expression (10), and the first initialization voltage Vini1 may be selected to satisfy Expressions (12) and (11).

$$|ELVDD - Vini1| < |ELVDD - Vini2| \tag{12}$$

At the time t3, as illustrated in FIG. 5, the voltage of the preceding scanning signal line Gi−1 changes to the high level, which causes the preceding scanning signal line Gi−1 to enter a non-select state. Therefore, the first initialization transistor M4 enters an off state. During the period from the time t3 to the start time t4 of the ith scanning select period, the data-side drive circuit 30 starts to apply the data signal D(j) to the data signal line Dj as the data voltage of the ith row, jth column pixel, and continues to apply the data signal D(j) until at least the end time t5 of the ith scanning select period.

At the time t4, as illustrated in FIG. 5, the voltage of the corresponding scanning signal line Gi changes from the high level to the low level, which causes the corresponding scanning signal line Gi to enter a select state. Therefore, the write control transistor M2, the threshold compensation transistor M3, and the first initialization transistor M4 change to the on state.

The period from the time t4 to the time t5 is a data write period in the ith pixel circuits Pix(i, 1) to Pix(i, m). In the data write period, the write control transistor M2 and the threshold compensation transistor M3 are in an on state as described above. FIG. 6(B) schematically illustrates the state of the pixel circuit Pix(i, j) in the data write period, i.e., the circuit state during the data write operation. In this data write period, similar to the known example described above, the voltage of the corresponding data signal line Dj is applied to the holding capacitor C1 as the data voltage Vdata via the drive transistor M1 in the diode-connected state. As a result, as illustrated in FIG. 5, the gate voltage Vg(i, j) changes toward the value given in Expression (5) above. That is, in the data write period, a data voltage that has undergone threshold compensation is written to the holding capacitor C1, and the gate voltage Vg(i, j) is the value given by Expression (5) above.

At the time t5, which is the end time of the ith scanning select period as the data write period, the voltage of the corresponding scanning signal line Gi changes to the high level. As a result, the write control transistor M2, the threshold compensation transistor M3, and the second initialization transistor M7 change to the off state.

Then, at the time t6, the voltage of the light emission control line Ei changes to a low level. Thus, the first and second light emission control transistors M5 and M6 change to the on state. The time after the time t6 is a light emission period. In this light emission period, in the pixel circuit Pix(i, j), the first and second light emission control transistors M5 and M6 are in an on state as described above, and the write control transistor M2, the threshold compensation transistor M3, the first initialization transistor M4, and the second initialization transistor M7 are in the off state. FIG. 6(C) schematically illustrates the state of the pixel circuit Pix(i, j) in the light emission period, i.e., the circuit state during the lighting operation. In the light emission period, similar to the known example described above, the current I1 flows from the high-level power source line ELVDD to the low-level power source line ELVSS via the first light emission control transistor M5, the drive transistor M1, the second light emission control transistor M6, and the organic EL element OLED. The current I1 corresponds to the voltage written to the holding capacitor C1 during the data write period (t4 to t5), and threshold compensation is performed simultaneously in the data write period to derive the current I1 by Expression (6). As a result, in the light emission period, similar to the known example described above, the organic EL element OLED emits light at a luminance corresponding to the data voltage Vdata, which is the voltage of the corresponding data signal line Dj in the ith scanning select period, regardless of the threshold voltage Vth of the drive transistor M1. Note that, as illustrated in FIG. 5, the anode voltage Va of the organic EL element OLED rises from the second initialization voltage Vini2 at the time t6 and, in the light emission period, changes from the low-level power supply voltage ELVSS to a voltage ELVSS+Vf that is a high as a forward direction voltage Vf of the organic EL element OLED.

1.5 Actions and Effects

In the present embodiment as described above, similar to the known example, in the pixel circuit Pix(i, j), the voltage of the corresponding data signal line Dj is applied to the holding capacitor C1 as the data voltage Vdata via the drive transistor M1 in the diode-connected state, thereby compensating for variations and fluctuations in the threshold voltage of the drive transistor M1. In order to write data along with this threshold compensation, the gate voltage Vg of the drive transistor M1 needs to be initialized (initialization of the holding voltage of the holding capacitor C1) prior to the data write operation. The voltage for initializing the gate voltage Vg is applied to the gate terminal of the drive transistor M1 via the first initialization transistor M4, similar to the known example (see FIG. 6(A)).

However, the present embodiment differs from the known example (FIG. 2) in that different initialization voltage lines (first and second initialization voltage lines) Vini1 and Vini2 are connected to the drain terminal of the first initialization transistor M4 and the drain terminal of the second initialization transistor M7, respectively, and the first initialization voltage Vini1 applied from the first initialization voltage line Vini1 for initialization of the gate voltage Vg of the drive transistor M1 as illustrated in FIG. 6(A) is higher than the second initialization voltage Vini2 applied from the second initialization voltage line Vini2 for initialization of the anode voltage Va of the organic EL element as illustrated in FIG. 6(C). Because the first initialization voltage Vini1 is set in this way, the voltage applied between the source and drain of the first initialization transistor M4 in the off state in the light emission period decreases lower than the voltage applied between the source and drain of the first initialization transistor M4 in the off state in the known example. This sufficiently reduces leakage current flowing from the gate terminal of the drive transistor M1 to the first initialization voltage line Vini1 via the first initialization transistor M4 in the off state in the light emission period. Thus, unlike the known example described above, it is possible to suppress a decrease in the gate voltage Vg due to leakage current from a transistor in the off state in the light emission period without increasing the size of the first initialization transistor M4. Thus, with the present embodiment, it is possible to provide a pixel circuit 15 having the same function as the pixel circuit 15*a* in the known example (including the function of threshold compensation) with no bright dot defects due to leakage current as described above without increasing the area of the pixel circuit 15.

According to the present embodiment, the gate voltage Vg of the drive transistor M1 is initialized with the first initialization voltage Vini1 that is higher than the second initialization voltage Vini2 of the anode voltage Va of the organic EL element OLED and the initialization voltage Vini of the gate voltage Vg in the known example (FIGS. 3 and 5). Thus, it is also possible to achieve an effect of improving the ratio of voltage actually written in the data write period to the voltage that should be written to the holding capacitor C1 by the data write operation, i.e., the charging rate of the holding capacitor C1.

Note that in the pixel circuit 15, the threshold compensation transistor M3 is connected to the gate terminal of the drive transistor M1 (one terminal of the holding capacitor C1) in addition to the first initialization transistor M4, and hence leakage current of the threshold compensation transistor M3 is also considered as leakage current that may lead to a decrease in the gate voltage Vg during the light emission period. However, in the light emission period, the anode voltage Va of the organic EL element OLED is higher than the voltage of the second initialization voltage line Vini2 by at least several volts, and the second light emission control transistor M6 is in the on state. Because of this, the voltage applied between the source and drain of the threshold compensation transistor M3 in the off state in the light emission period is a relatively small voltage corresponding to the difference between the gate voltage Vg of the drive transistor M1 and the anode voltage Va, and reduction of the gate voltage Vg due to leakage current of the threshold compensation transistor M3 is not a problem.

1.6 Modification Example of First Embodiment

Figure 7:
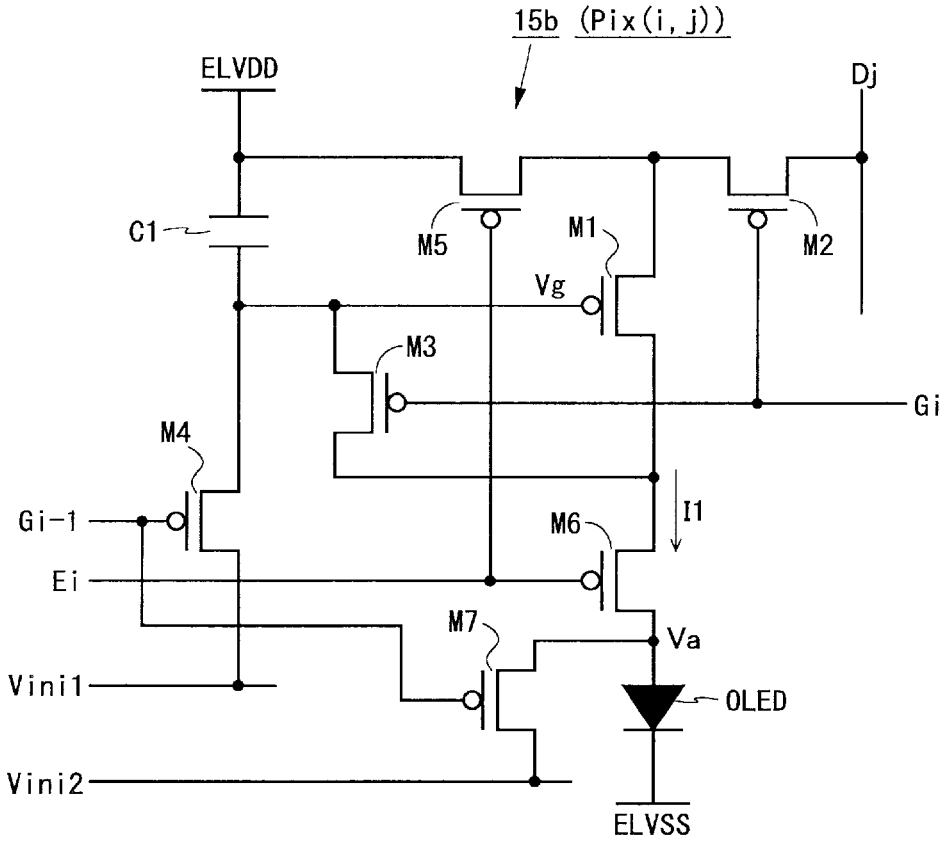
FIG. 7 is a circuit diagram illustrating a configuration of a pixel circuit according to a modification example of the first embodiment.

In the pixel circuit 15 according to the first embodiment, the gate terminal of the second initialization transistor M7 is connected to the corresponding scanning signal line Gi, but may be connected to the preceding scanning signal line Gi−1 instead. A display device including a pixel circuit having such a configuration will be described below as a modification example of the first embodiment. FIG. 7 is a circuit diagram illustrating a configuration of a pixel circuit 15*b* according to the present modification example. This pixel circuit 15*b* only differs from the pixel circuit 15 in the first embodiment in terms of the connection destination of the gate terminal of the second initialization transistor M7. Thus, the same reference signs will be assigned to the same components and detailed descriptions of those components will be omitted.

Figure 8:
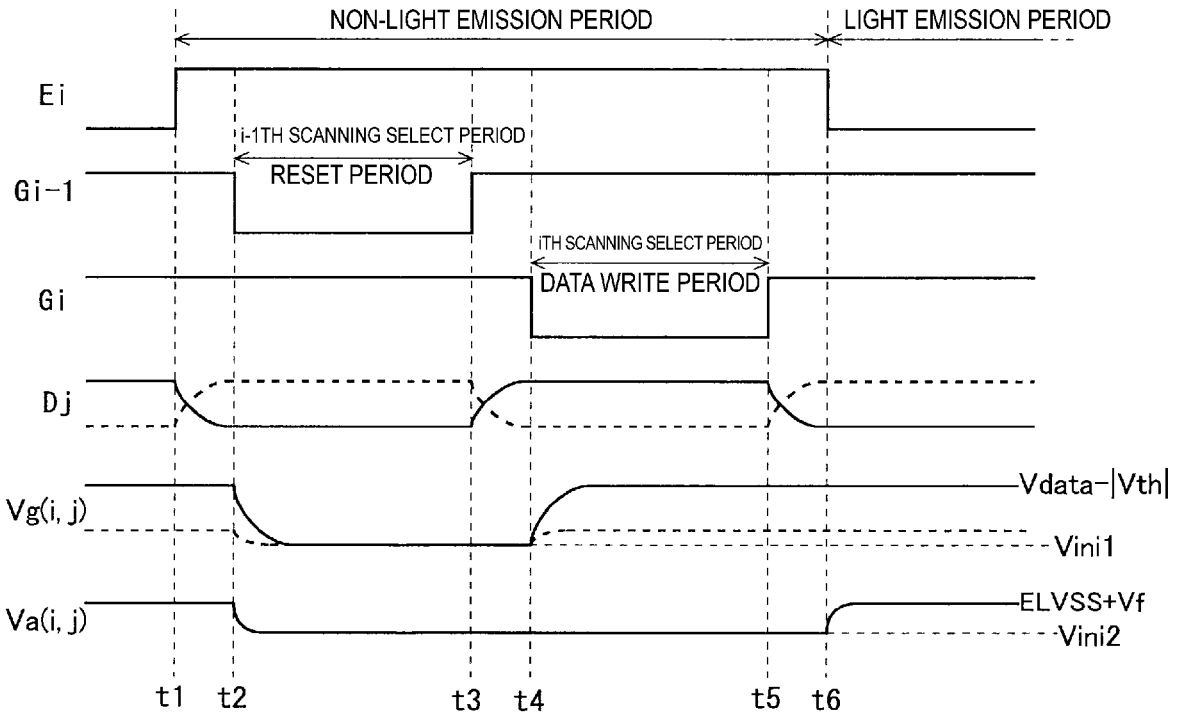
FIG. 8 is a signal waveform diagram for explaining drive of a display device according to a modification example of the first embodiment.

FIG. 8 is a signal waveform diagram for explaining drive of a display device according to the present modification example. In the ith row, jth column pixel circuit 15*b* (pixel circuit Pix(i, j)) in the present modification example, the preceding scanning signal line Gi−1 is connected to the gate terminal of the second initialization transistor M7. Thus, at the start time t2 of the i-1th scanning select period, the second initialization voltage Vini2 is applied to the anode electrode of the organic EL element OLED from the second initialization voltage line Vini2 via the second initialization transistor M7. As a result, the anode voltage Va is initialized to the second initialization voltage Vini2 and maintained at the second initialization voltage Vini2 until the end time t6 of the non-light emission period.

The present modification example differs from the first embodiment in terms of operation for initializing the anode voltage Va as described above, but other operations are the same as those of the first embodiment (see FIGS. 5, 6, and 8), and the same effects as the first embodiment are achieved.

Note that in the first embodiment and the modification example, the low-level power supply voltage ELVSS can be selected as the second initialization voltage Vini2. In this case, the low-level power source line ELVSS is preferably shared as the second initialization voltage line Vini2. With this configuration, the wiring area for initializing each pixel circuit Pix(i, j) can be reduced.

2. Second Embodiment

2.1 Overall Configuration

Figure 9:
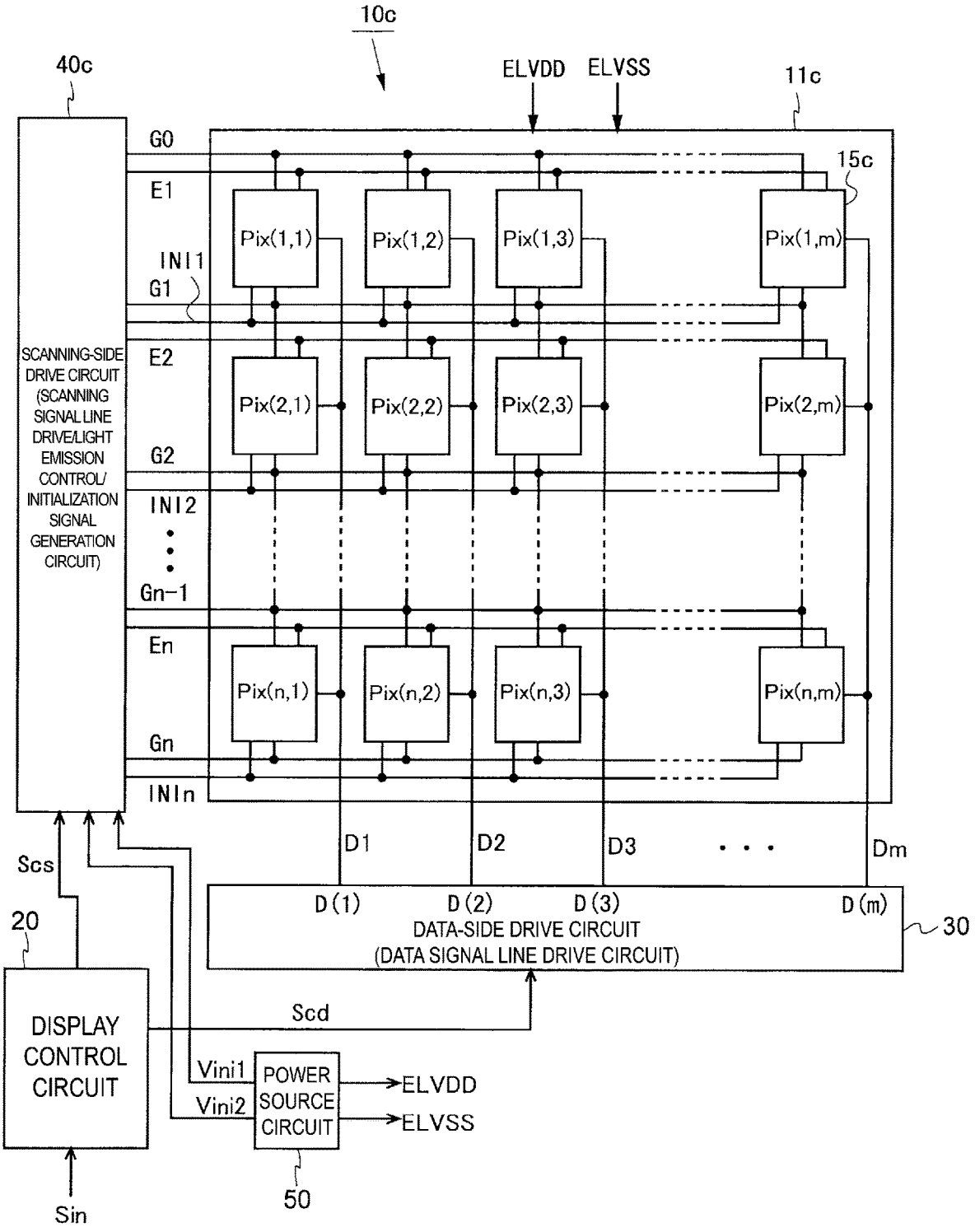
FIG. 9 is a block diagram illustrating an overall configuration of a display device according to a second embodiment.

FIG. 9 is a block diagram illustrating an overall configuration of an organic EL display device 10*c* according to a second embodiment. The display device 10*c* is also an organic EL display device that performs internal compensation. As illustrated in FIG. 9, the display device 10*c* includes a display portion 11*c*, the display control circuit 20, the data-side drive circuit 30, a scanning-side drive circuit 40*c*, and the power source circuit 50. The data-side drive circuit 30 functions as a data signal line drive circuit (data driver). The scanning-side drive circuit 40*c* functions as a scanning signal line drive circuit (gate driver) and a light emission control circuit (emission driver) similar to the first embodiment, and also functions as an initialization signal generation circuit, which is different from the first embodiment. The power source circuit 50 generates the high-level power supply voltage ELVDD and the low-level power supply voltage ELVSS to be supplied to the display portion 11*c*, the first initialization voltage Vini1 and the second initialization voltage Vini2 as fixed voltages to be supplied to the scanning-side drive circuit 40*c*, and power supply voltages to be supplied to the display control circuit 20, the data-side drive circuit 30, and the scanning-side drive circuit 40*c*.

Similar to the display portion 11 in the first embodiment (FIG. 1), the display portion 11*c* includes m (m is an integer of 2 or greater) data signal lines D1 to Dm, n+1 (n is an integer of 2 or greater) scanning signal lines G0 to Gn intersecting the data signal lines D1 to Dm, and n light emission control lines (emission lines) E1 to En disposed along the n scanning signal lines G1 to Gn. As illustrated in FIG. 9, the display portion 11c is provided with m×n pixel circuits 15c arranged in a matrix along the m data signal lines D1 to Dm and the n scanning signal lines G1 to Gn. Each pixel circuit 15c corresponds to any one of the m data signal lines D1 to Dm and any one of the n scanning signal lines G1 to Gn (hereinafter, when distinguishing between each pixel circuit 15c, similar to the first embodiment, a pixel circuit corresponding to the ith scanning signal line Gi and the jth data signal line Dj is also referred to as an "ith row, jth column pixel circuit" and is denoted by the reference sign "Pix(i, j)"). The display portion 11c of the present embodiment also includes n initialization signal lines INI1 to INIn disposed along the n scanning signal lines G1 to Gn, respectively. The n light emission control lines E1 to En correspond to the n scanning signal lines G1 to Gn, respectively, and the n initialization signal lines INI1 to INIn correspond to the n scanning signal lines G1 to Gn, respectively. Accordingly, each pixel circuit 15c corresponds to any one of the n light emission control lines E1 to En and any one of the n initialization signal lines INI1 to INIn.

The display portion 11c also includes, as power source lines (not illustrated) common to each pixel circuit 15c, a power source line for supplying the high-level power supply voltage ELVDD (hereinafter referred to as "high-level power source line" and indicated by the same reference sign as the high-level power supply voltage ELVDD) to drive organic EL elements (described later) and a power source line for supplying the low-level power supply voltage ELVSS (referred to below as "low-level power source lines" and indicated by the same reference sign as the low-level power supply voltage ELVSS) for driving the organic EL element. However, unlike the first embodiment, the display portion 11c does not include the first and second initialization voltage lines Vini1 and Vini2 used for supplying the first and second initialization voltages Vini1 and Vini2 to each pixel circuit 15c. Instead, an initialization signal line INIi corresponding to each pixel circuit is used for the initialization of each pixel circuit 15c (details described later). In the present embodiment, an initialization voltage supply circuit is realized by the n initialization signal lines INI1 to INIn and an initialization signal generation circuit in the scanning-side drive circuit 40c.

The configuration and operation of the display control circuit 20 and the data-side drive circuit 30 are the same as those of the first embodiment, and thus detailed descriptions of these components will be omitted.

Figure 11:
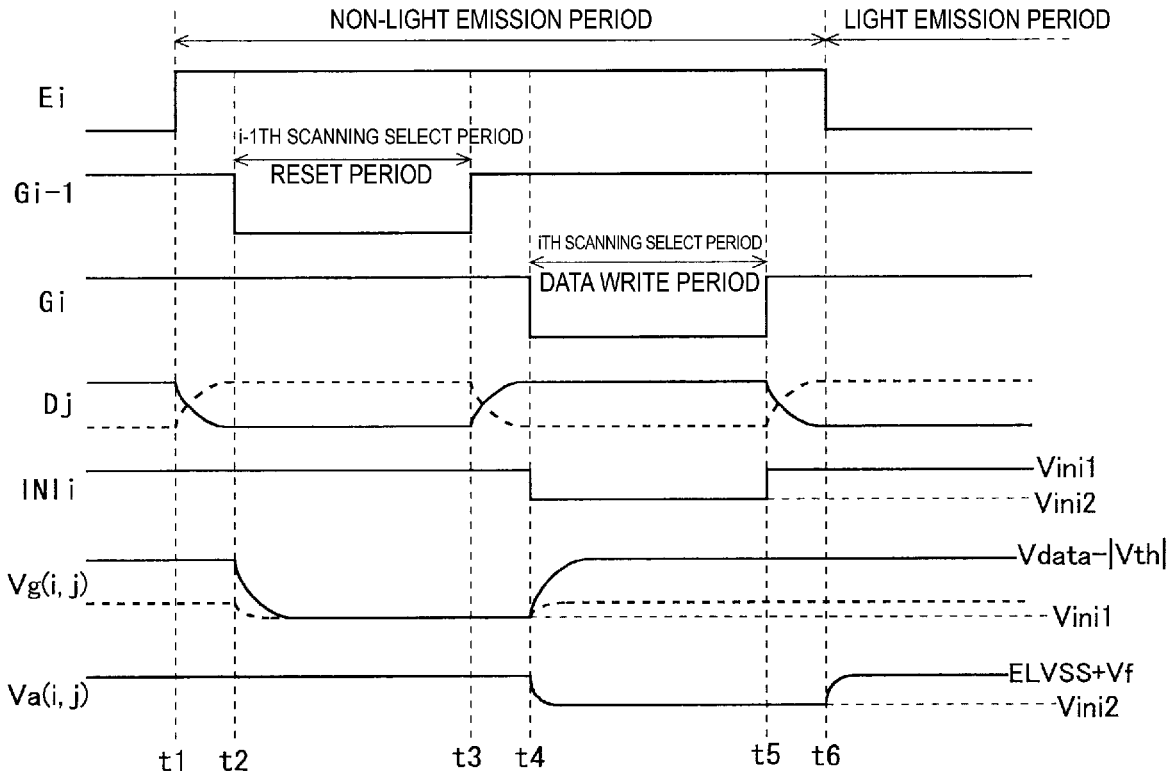
FIG. 11 is a signal waveform diagram for explaining drive of the display device according to the second embodiment.

Similar to the first embodiment, the scanning-side drive circuit 40c functions as a scanning signal line drive circuit that drives the scanning signal lines G0 to Gn and a light emission control circuit that drives the light emission control lines E1 to En based on the scanning-side control signal Scs output from the display control circuit 20 (see FIG. 5, and FIG. 11 to be described later). In addition, the scanning-side drive circuit 40c differs from the first embodiment in that the scanning-side drive circuit 40c functions as an initialization signal generation circuit that generates initialization signals INI(1) to INI(n) to be applied to the initialization signal lines INI1 to INIn based on the scanning-side control signal Scs output from the display control circuit 20 and the first and second initialization voltages Vini1 and Vini2 output from the power source circuit 50. More specifically, as illustrated in FIG. 11, the scanning-side drive circuit 40c generates an initialization signal INI(i) to be applied to the ith initialization signal line INIi as a voltage signal that has the voltage of the second initialization voltage Vini2 in the select period (ith scanning select period) of the ith scanning signal line Gi, and the first initialization voltage Vini1 in other periods (i=1 to n).

2.2 Configuration and Operation of Pixel Circuit in Present Embodiment

Figure 10:
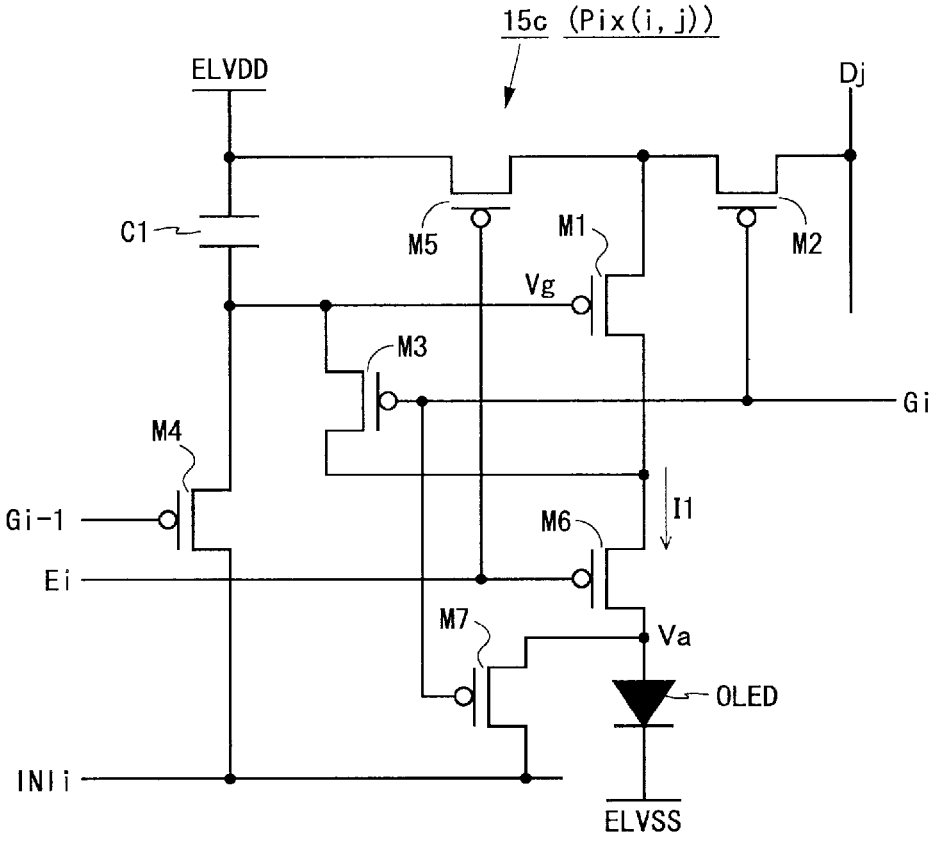
FIG. 10 is a circuit diagram illustrating a configuration of a pixel circuit according to the second embodiment.

Next, the configuration and operation of the pixel circuit 15c according to the present embodiment will be described with reference to FIGS. 10 and 11. FIG. 10 is a circuit diagram illustrating a configuration of the pixel circuit 15c according to the present embodiment. FIG. 11 is a signal waveform diagram for explaining drive of the organic EL display device 10 according to the present embodiment.

FIG. 10 illustrates the configuration of a pixel circuit 15c corresponding to the ith scanning signal line Gi and the jth data signal line Dj in the present embodiment, i.e., the configuration of an ith row, jth column pixel circuit Pix(i, j) ($1 \leq i \leq n$, $1 \leq j \leq m$). Similar to the pixel circuit 15 (FIG. 4) in the first embodiment, the pixel circuit 15c includes, as circuit elements, the organic EL element OLED, the drive transistor M1, the write control transistor M2, the threshold compensation transistor M3, the first initialization transistor M4, the first light emission control transistor M5, the second light emission control transistor M6, the second initialization transistor M7, and the holding capacitor C1, and the connection relationship between these circuit elements is the same as in the pixel circuit 15 in the first embodiment. Note that also in the pixel circuit 15c according to the present embodiment, the transistors M2 to M7 other than the drive transistor M1 function as switching elements.

As illustrated in FIG. 9, in the pixel circuit 15c, similar to the first embodiment, a scanning signal line (corresponding scanning signal line) Gi corresponding to the pixel circuit 15c, a scanning signal line (preceding scanning signal line) Gi immediately before the corresponding scanning signal line Gi−1, a light emission control line (corresponding light emission control line) Ei corresponding to the preceding scanning signal line Gi−1, a data signal line (corresponding data signal line) Dj corresponding to the corresponding light emission control line Ei, the high-level power source line ELVDD, and the low-level power source line ELVSS are connected to each other. In the first embodiment, the first and second initialization voltage lines Vini1 and Vini2 are connected to all the pixel circuits 15 (see FIGS. 1, 2, and 4), whereas in the present embodiment, the ith initialization signal line INIi is connected to the ith row, jth column pixel circuit Pix(i, j) (see FIGS. 9 and 10). In other words, in the ith row, jth column pixel circuit Pix(i, j), the gate terminal of the drive transistor M1 (one terminal of the holding capacitor C1) is connected to the ith initialization signal line INIi via the first initialization transistor M4, and the anode electrode serving as the first terminal of the organic EL element OLED is connected to the ith initialization signal line INIi, i.e., a corresponding initialization signal line (hereinafter also referred to as "corresponding initialization signal line" in the description focusing on pixel circuits) INIi via the second initialization transistor M7.

FIG. 11 illustrates fluctuation in the voltages of signal lines (corresponding light emission control line Ei, preceding scanning signal line Gi−1, corresponding scanning signal line Gi, corresponding data signal line Dj, and corresponding initialization signal line INIi) in the initialization operation, the reset operation, and the lighting operation of the pixel circuit 15c illustrated in FIG. 10, i.e., the ith row, jth column pixel circuit Pix(i, j), the gate voltage Vg of the drive transistor M1, and the anode voltage Va of the organic EL element OLED. Note that the reference signs "Vg(i, j)" and "Va(i, j)" are used to differentiate the gate voltage Vg and the anode voltage Va in the pixel circuit Pix(i, j) from the gate voltage Vg and the anode voltage Va in other pixel circuits, respectively.

In the present embodiment, turning on/off each of the transistors M2 to M7 as switching elements in the pixel circuit Pix(i, j) is controlled in the same manner as in the first embodiment (see FIGS. 5 and 11). Thus, also in the present embodiment, the period from the time t2 to the time t3 is the reset period of the pixel circuit Pix(i, j). In this reset period, as illustrated in FIG. 11, the voltage of the ith initialization signal line INIi is the first initialization voltage Vini1, and the voltage Vini1 is applied to the gate terminal of the drive transistor M1 via the first initialization transistor M4 in the on state to initialize the gate voltage Vg (holding voltage of the holding capacitor C1). As a result, the gate voltage Vg is initialized to the first initialization voltage Vini1 similar to the first embodiment.

The period from the time t4 to the time t5 is the data write period of the pixel circuit Pix(i, j). In this data write period, as illustrated in FIG. 11, a data voltage that has undergone threshold compensation is written to the holding capacitor C1, and the anode voltage Va of the organic EL element OLED is initialized, similar to the first embodiment (FIG. 6(B)). That is, as illustrated in FIG. 11, in the data write period, the voltage of the ith initialization signal line INIi is the second initialization voltage Vini2, and the voltage Vini2 is applied to the anode electrode of the organic EL element OLED via the second initialization transistor M7 in the on state to initialize the anode voltage Va. As a result, the anode voltage Va is initialized to the second initialization voltage Vini2 similar to the first embodiment.

At the time t5, which is the end time of the ith scanning select period as the data write period, the write control transistor M2, the threshold compensation transistor M3, and the second initialization transistor M7 change to the off state, and the voltage of the ith initialization signal line INIi changes to the first initialization voltage Vini1, similar to the first embodiment. Thereafter, the voltage of the ith initialization signal line INIi is maintained at the first initialization voltage Vini1 until the start time of the ith scanning select period in the next non-light emission period.

Also in the present embodiment and similar to the first embodiment, the time t6 onward is a light emission period. In this light emission period, in the pixel circuit Pix(i, j), the first and second light emission control transistors M5 and M6 are in the on state and the write control transistor M2, the threshold compensation transistor M3, the first initialization transistor M4, and the second initialization transistor M7 are in the off state. As a result, similar to the first embodiment, the current I1 given by Expression (6) flows from the high-level power source line ELVDD to the low-level power source line ELVSS via the first light emission control transistor M5, the drive transistor M1, the second light emission control transistor M6, and the organic EL element OLED. Thus, in the light emission period, the organic EL element OLED emits light at a luminance corresponding to the data voltage Vdata, which is the voltage of the corresponding data signal line Dj in the ith scanning select period, regardless of the threshold voltage Vth of the drive transistor M1. Further, in this light emission period, the voltage of the initialization signal line INIi is maintained at the first initialization voltage Vini1 that is higher than the second initialization voltage Vini2.

2.3 Actions and Effects

As described above, also in the present embodiment, in the pixel circuit Pix(i, j), the gate voltage Vg of the drive transistor M1 needs to be initialized (initialization of the holding voltage of the holding capacitor C1) before the voltage of the corresponding data signal line Dj is applied to the holding capacitor C1 as the data voltage Vdata via the drive transistor M1 in the diode-connected state. In the present embodiment, unlike in the first embodiment, voltage of the same initialization signal line INIi is used in the initialization of both the gate voltage Vg of the drive transistor M1 and the anode voltage Va of the organic EL element OLED. Because the voltage of the initialization signal line INIi is the first initialization voltage Vini1 during the i-1th scanning select period and the second initialization voltage Vini2 in the ith scanning select period, the gate voltage Vg is initialized to the first initialization voltage Vini1 and the anode voltage Va is initialized to the second initialization voltage Vini2 (see FIG. 11) similar to the first embodiment. Accordingly, effects similar to those of the first embodiment can be obtained. Additionally, with the present embodiment, in place of the first and second initialization voltage lines Vini1 and Vini2, the voltages Vini1 and Vini2 used for initializing the gate voltage Vg and the anode voltage Va with the initialization signal line INIi are supplied. Thus, the wiring area for the initialization of each pixel circuit Pix(i, j) is reduced further than in the known example and the first embodiment.

2.4 First Modification Example of Second Embodiment

Figure 12:
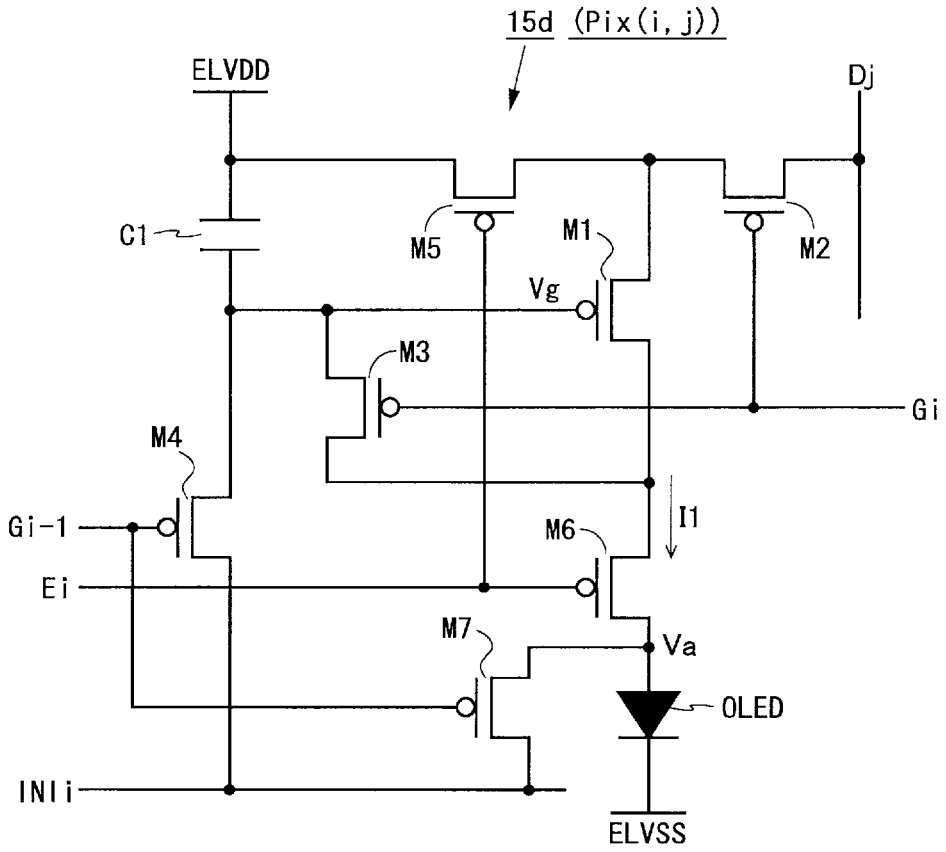
FIG. 12 is a circuit diagram illustrating a configuration of a pixel circuit according to a first modification example of the second embodiment.

In the pixel circuit 15*c* according to the second embodiment, the gate terminal of the second initialization transistor M7 is connected to the corresponding scanning signal line Gi, but the gate terminal may be connected to the preceding scanning signal line Gi−1 instead. A display device including a pixel circuit having such a configuration will be described below as a first modification example of the second embodiment. FIG. 12 is a circuit diagram illustrating a configuration of a pixel circuit 15*d* according to the present modification example. This pixel circuit 15*d* only differs from the pixel circuit 15*b* in the second embodiment in terms of the connection destination of the gate terminal of the second initialization transistor M7, and hence the same reference signs are assigned to the same components and detailed of those components will be omitted.

Figure 13:
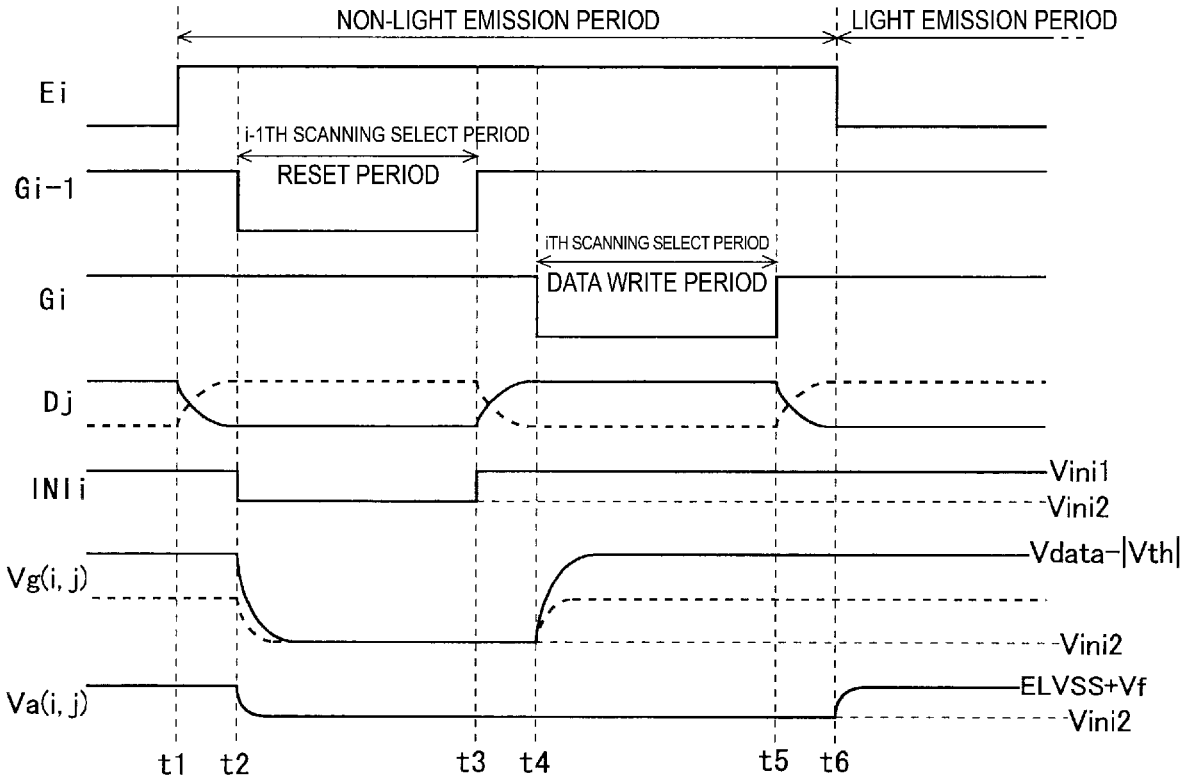
FIG. 13 is a signal waveform diagram illustrating drive of a display device according to the first modification example of the second embodiment.

FIG. 13 is a signal waveform diagram for explaining drive of a display device according to the present modification example. In the present modification example, the voltage waveform of the initialization signal line INIi is different from that in the second embodiment, and the voltage of the initialization signal line INIi is the second initialization voltage Vini2 in the i-1th scanning select period, which is the select period of the preceding scanning signal line Gi−1, in each non-light emission period and the first initialization voltage Vini1 in other periods. In addition, in the ith row, jth column pixel circuit 15*d* (pixel circuit Pix(i, j)) in the present modification example, the preceding scanning signal line Gi−1 is connected to the gate terminal of the second initialization transistor M7. Thus, in the i-1th scanning select period, which is the reset period, the second initialization voltage Vini2 is applied from the ith initialization signal line INIi to the gate terminal of the drive transistor M1 (one terminal of the holding capacitor C1) via the first initialization transistor M4, and the second initialization voltage Vini2 is applied from the initialization signal line INIi to the anode electrode of the organic EL element OLED via the second initialization transistor M7. With this configuration, both the gate voltage Vg of the drive transistor M1 and the anode voltage Va of the organic EL element OLED are initialized to the second initialization voltage Vini2. Thereafter, as illustrated in FIG. 13, the gate voltage Vg is maintained at the second initialization voltage Vini2 until the start time t4 of the ith scanning select period as the data write period, and the anode voltage Va is maintained at the second initialization voltage Vini2 until the start time t6 of the light emission period.

Operations other than those described above in the display device according to the present modification example are the same as those of the second embodiment. In the light emission period, the voltage of the initialization signal line INIi is maintained at the first initialization voltage Vini1 (>Vini2) (see FIGS. 11 and 13). Accordingly, effects similar to those of the second embodiment can also be obtained in the present embodiment. However, because the gate voltage Vg of the drive transistor M1 is initialized to the second initialization voltage Vini2 that is lower than the first initialization voltage Vini1, the second embodiment is more advantageous in terms of the charge rate of the holding capacitor C1 in subsequent data write operations.

2.5 Other Modification Examples in Second Embodiment

Figure 14:
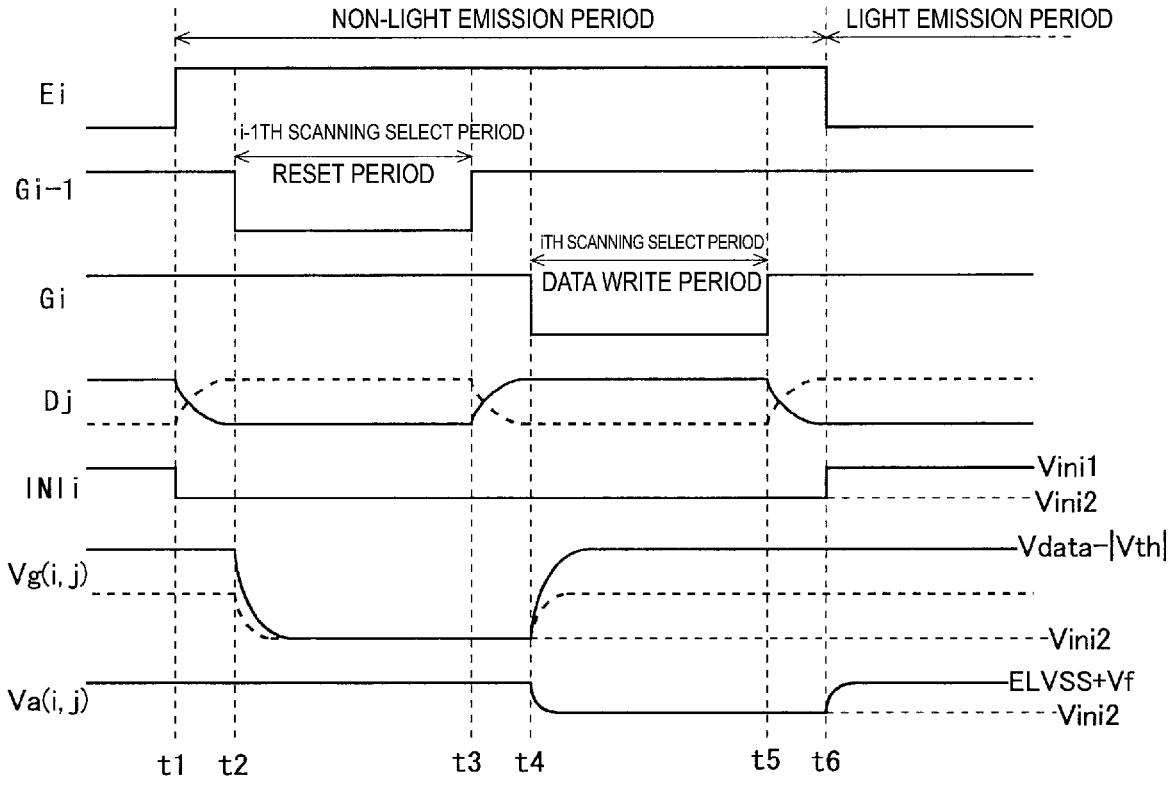
FIG. 14 is a signal waveform diagram illustrating drive of a display device according to a second modification example of the second embodiment.
Figure 15:
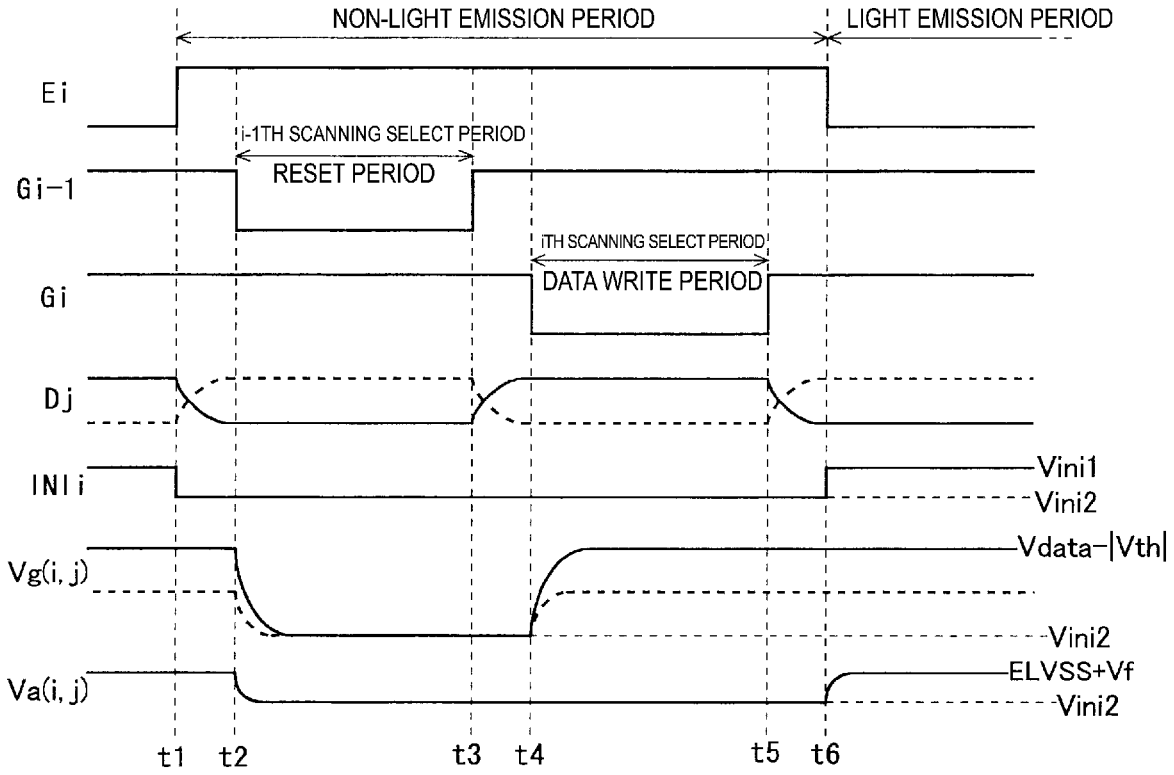
FIG. 15 is a signal waveform diagram illustrating drive of a display device according to a third modification example of the second embodiment.

In the second embodiment and the first modification example described above, the voltage of the initialization signal line INIi changes synchronously with a signal change of the corresponding scanning signal line Gi or the preceding scanning signal line Gi−1 (FIGS. 11 and 13), but the voltage change of the initialization signal line INIi is not limited to this. A period in which the voltage of the initialization signal line INIi is the second initialization voltage Vini2 need only be within a non-light emission period in which the signal of the light emission control line Ei is non-active and include a period in which the second initialization transistor M7 of the pixel circuit Pix(i, j) is in an on state (i=1 to n, j=1 to m). For example, as illustrated in FIGS. 14 and 15, the voltage of the ith initialization signal line INIi may be the second initialization voltage Vini2 in the non-light emission period in which the signal of the ith light emission control line Ei is non-active, and the first initialization voltage Vini1 in other periods. In other words, the initialization signal generation circuit may be configured such that the voltage of the initialization signal line INIi changes synchronously with a signal change of the light emission control line Ei. However, because the non-light emission period is longer than the scanning select period, in such a configuration, a period in which the voltage of the initialization signal line INIi is maintained at the first initialization voltage Vini1 (>Vini2) is shorter than in the second embodiment and the first modification example described above. For this reason, in terms of the charge rate of the holding capacitor C1 in the data write operation, a configuration in which the voltage of the initialization signal line INIi changes synchronously with the signal change of the scanning signal line Gi (FIGS. 11 and 13) such as that in the second embodiment and the first modification example is advantageous.

FIG. 14 is a signal waveform diagram illustrating drive of an organic EL display device (hereinafter referred to as "second modification example of the second embodiment") in which an ith row, jth column pixel circuit Pix(i, j) is configured similarly to the pixel circuit 15*c* in the second embodiment illustrated in FIG. 10, and in which an initialization signal generation circuit is configured such that the voltage of the initialization signal line INIi changes synchronously with the signal change of the light emission control line Ei. As illustrated in FIG. 14, in the present modification example, the voltage change of the initialization signal line INIi differs from the first modification example (FIG. 13) and the change of the anode voltage Va of the organic EL element OLED differs from the first modification example (FIG. 13) and is similar to the second embodiment (FIG. 11), but other operations are the same as that of the first modification example, and the voltage of the initialization signal line INIi is maintained at the first initialization voltage Vini1 (>Vini2) in the light emission period. Thus, the present modification example can achieve the same effects as those of the first modification example.

FIG. 15 is a signal waveform diagram illustrating drive of an organic EL display device (hereinafter referred to as "third modification example of the second embodiment") in which an ith row, jth column pixel circuit Pix(i, j) is configured similarly to the pixel circuit 15*d* in the first modification example illustrated in FIG. 12, and in which an initialization signal generation circuit is configured such that the voltage of the initialization signal line INIi changes synchronously with the signal change of the light emission control line Ei. As illustrated in FIG. 15, in the present modification example, the voltage change of the initialization signal line INIi is different from the first modification example (FIG. 13), but other operations are the same as the first modification example, and the voltage of the initialization signal line INIi is maintained at the first initialization voltage Vini1 (>Vini2) in the light emission period. Thus, the present modification example can achieve the same effects as those of the first modification example.

3. Other Modification Examples

The disclosure is not limited to the embodiments described above, and various modifications may be made without departing from the scope of the disclosure.

In the above description, an organic EL display device has been described as an example and embodiments and modification examples thereof have been given. However, the disclosure is not limited to an organic EL display device and may be applied to any display device employing an internal compensation method using a display element driven by a current. The display element that can be used in such a configuration is a display element in which luminance, transmittance, or other factors are controlled by a current and includes, for example, an organic EL element, i.e., an organic light-emitting diode (OLED), or an inorganic light-emitting diode or a quantum dot light-emitting diode (QLED).

REFERENCE SIGNS LIST

10, 10*c* Organic EL display device
11, 11*c* Display portion
15, 15*b*, 15*c*, 15*d* Pixel circuit
Pix(i, j) Pixel circuit (i=1 to n, j=1 to m)
20 Display control circuit
30 Data-side drive circuit (data signal line drive circuit)
40 Scanning-side drive circuit (scanning signal line drive/light emission control circuit)
40C Scanning-side drive circuit (scanning signal line drive/light emission control/initialization signal generation circuit)
Gi Scanning signal line (i=1 to n)
Ei Light emission control line (i=1 to n)
INIi Initialization signal line (i=1 to n)

Dj Data signal line (j=1 to m)

Vini1 First initialization voltage line, first initialization voltage

Vini2 Second initialization voltage line, second initialization voltage

ELVDD High-level power source line (first power source line), high-level power supply voltage ELVSS Low-level power source line (second power source line), low-level power supply voltage OLED Organic EL element C1 Holding capacitor M1 Drive transistor M2 Write control transistor (write control switching element)

M3 Threshold compensation transistor (threshold compensation switching element)

M4 First initialization transistor (first initialization switching element)

M5 First light emission control transistor (first light emission control switching element)

M6 Second light emission control transistor (first light emission control switching element)

M7 Second initialization transistor (second initialization switching element)

The invention claimed is:

1. A display device including a plurality of data signal lines, a plurality of scanning signal lines intersecting the plurality of data signal lines, a plurality of light emission control lines corresponding to the respective scanning signal lines, and a plurality of pixel circuits arranged in a matrix along the plurality of data signal lines and the plurality of scanning signal lines, the display device comprising:

first and second power source lines;

an initialization voltage supply circuit;

a data signal line drive circuit configured to drive the plurality of data signal lines;

a scanning signal line drive circuit configured to selectively drive the plurality of scanning signal lines; and a light emission control circuit configured to drive the plurality of light emission control lines, each pixel circuit comprising:

a display element driven by a current;

a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and first and second initialization switching elements, wherein a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, the second conduction terminal via the threshold compensation switching element, and a first conduction terminal of the first initialization switching element, the first terminal of the display element is connected to a first conduction terminal of the second initialization switching element, and a second terminal of the display element is connected to the second power source line, the first initialization switching element is controlled to an on state when a holding voltage of the holding capacitor is to be initialized, the second initialization switching element is controlled to an on state when the first terminal of the display element is to be initialized, and the first initialization transistor is controlled to an off state when the display element is to be driven based on the holding voltage of the holding capacitor, control terminals of the write control switching element and the threshold compensation switching element are connected to any one of the plurality of scanning signal lines, control terminals of the first and second light emission control switching elements are connected to a light emission control line corresponding to the any one of the plurality of scanning signal lines, a control terminal of the first initialization switching element is connected to a preceding scanning signal line, which is a scanning signal line selected immediately before selecting the any one of the plurality of scanning signal lines, and a control terminal of the second initialization switching element is connected to one of the any one of the plurality of scanning signal lines and the preceding scanning signal line, and the initialization voltage supply circuit comprises:

a plurality of initialization signal lines corresponding to the respective scanning signal lines; and an initialization signal generation circuit configured to generate a plurality of initialization signals to be applied to the plurality of initialization signal lines, respectively, in each pixel circuit, the second conduction terminals of the first and second initialization switching elements are both connected to one initialization signal line corresponding to the any one of the plurality of scanning signal lines, and the initialization signal generation circuit is configured to generate an initialization signal to be applied to each initialization signal line such that the initialization signal has a first initialization voltage when the holding voltage of the holding capacitor is to be initialized in a pixel circuit to which the each initialization signal line is connected and the initialization signal has a second initialization voltage when the first terminal of the display element is to be initialized in the pixel circuit, and such that when the display element is to be driven based on the holding voltage of the holding capacitor, an absolute value of a difference between a voltage of the initialization signal and a voltage of the second power source line is larger than an absolute value of a difference between the second initialization voltage and a voltage of the second power source line; and in a pixel circuit to which the each initialization signal line is connected, when the display element is to be driven based on the holding voltage of the holding capacitor, a voltage between the first and second conduction terminals of the first initialization switching element is smaller than an absolute value of a difference between a voltage of the first conduction terminal of the first initialization switching element and the second initialization voltage.

2. The display device according to claim 1, wherein the first initialization switching element is controlled to an on state and the threshold compensation switching element is controlled to an off state when the holding voltage of the holding capacitor is to be initialized, and the second initialization switching element is controlled to an on state and the second light emission control switching element is controlled to an off state when the first terminal of the display element is to be initialized.

3. The display device according to claim 2, wherein, when writing a voltage of the any one of the plurality of data signal lines to the holding capacitor as a data voltage, the write control switching element and the threshold compensation switching element are controlled to an on state, and the first light emission control switching element, the second light emission control switching element, and the first initialization switching element are controlled to an off state.

4. The display device according to claim 3, wherein, when the display element is to be driven based on the holding voltage of the holding capacitor, the first light emission control switching element and the second light emission control switching element are controlled to an on state, and the write control switching element, the threshold compensation switching element, the first initialization switching element, and the second initialization switching element are controlled to an off state.

5. The display device according to claim 1, wherein the control terminal of the second initialization switching element is connected to the any one of the plurality of scanning signal lines.

6. The display device according to claim 1, wherein, in the scanning signal line drive circuit, a plurality of scanning signals are applied to the respective scanning signal lines such that the plurality of scanning signal lines are sequentially selected in predetermined periods, the plurality of scanning signals being sequentially activated in each predetermined period, and in the light emission control circuit, for each of the plurality of scanning signal lines, a light emission control signal is applied to a light emission control line corresponding to the scanning signal line, the light emission control signal being a signal where a non-light emission period including a select period of the scanning signal line and a select period of the preceding scanning signal line, which is a scanning signal line selected immediately before selecting the plurality of scanning signal lines, is inactive, and a light emission period including a select period of a scanning signal line other than the scanning signal line and the preceding scanning signal line is active.

7. The display device according to claim 1, wherein in a pixel circuit to which the each initialization signal line is connected, a voltage between the first and second conduction terminals of the first initialization switching element during a period when the display element is to be driven based on the holding voltage of the holding capacitor is smaller than a voltage between the first and second conduction terminals of the first initialization switching element during a period when the first terminal of the display element is to be initialized.

8. The display device according to claim 1, wherein the drive transistor is a P-channel transistor, the first power source line is a high-level power source line, the second power source line is a low-level power source line, and the first initialization voltage is higher than the second initialization voltage.

9. The display device according to claim 8, wherein, when writing a voltage of any one of the plurality of data signal lines to the holding capacitor as a data voltage, the first initialization voltage is lower than the voltage of the any one of the plurality of data signal lines, and an absolute value of a difference between the voltage of the any one of the plurality of data signal lines and the first initialization voltage is larger than an absolute value of a threshold voltage of the drive transistor.

10. The display device according to claim 8, wherein each initialization signal line has the first initialization voltage during a period when the display element is to be driven based on the holding voltage of the holding capacitor in a pixel circuit to which the each initialization signal line is connected.

11. A method for driving a display device including a plurality of data signal lines, a plurality of scanning signal lines intersecting the plurality of data signal lines, a plurality of light emission control lines corresponding to the respective scanning signal lines, first and second power source lines, and a plurality of pixel circuits arranged in a matrix along the plurality of data signal lines and the plurality of scanning signal lines, the method for driving a display device comprising:

an initialization voltage supply step of supplying a voltage used for initialization to each pixel circuit, each pixel circuit comprising:

a display element driven by a current;

a holding capacitor configured to hold a voltage used for controlling a drive current of the display element;

a drive transistor configured to control a drive current of the display element according to a voltage held by the holding capacitor;

a write control switching element;

a threshold compensation switching element;

first and second light emission control switching elements; and first and second initialization switching elements, wherein a first conduction terminal of the drive transistor is connected to any one of the plurality of data signal lines via the write control switching element, and the first power source line via the first light emission control switching element, a second conduction terminal of the drive transistor is connected to a first terminal of the display element via the second light emission control switching element, a control terminal of the drive transistor is connected to the first power source line via the holding capacitor, the second conduction terminal via the threshold compensation switching element, and a first conduction terminal of the first initialization switching element, the first terminal of the display element is connected to a first conduction terminal of the second initialization switching element, and a second terminal of the display element is connected to the second power source line, the first initialization switching element is controlled to an on state when a holding voltage of the holding capacitor is to be initialized, the second initialization switching element is controlled to an on state when the first terminal of the display element is to be initialized, and the first initialization transistor is controlled to an off state when the display element is to be driven based on the holding voltage of the holding capacitor, the initialization voltage supply step includes generating a plurality of initialization signals corresponding to the respective scanning signal lines, in the initialization voltage supply step, any one of the plurality of initialization signals is supplied to both the second conduction terminals of the first and second initialization switching elements in each pixel circuit, and an initialization signal corresponding to each scanning signal line is generated such that the initialization signal has a first initialization voltage when the holding voltage of the holding capacitor is to be initialized in a pixel circuit to which the each scanning signal line is connected and the initialization signal has a second initialization voltage when the first terminal of the display element is to be initialized in the pixel circuit, and such that when the display element is to be driven based on the holding voltage of the holding capacitor, an absolute value of a difference between a voltage of the initialization signal and a voltage of the second power source line is larger than an absolute value of a difference between the second initialization voltage and a voltage of the second power source line, and in a pixel circuit to which the each scanning signal line is connected, when the display element is to be driven based on the holding voltage of the holding capacitor, a voltage between the first and second conduction terminals of the first initialization switching element is smaller than an absolute value of a difference between a voltage of the first conduction terminal of the first initialization switching element and the second initialization voltage.

12. The method for driving a display device according to claim 11, wherein the first initialization switching element is controlled to an on state and the threshold compensation switching element is controlled to an off state when the holding voltage of the holding capacitor is to be initialized, and the second initialization switching element is controlled to an on state and the second light emission control switching element is controlled to an off state when the first terminal of the display element is to be initialized.

13. The method for driving a display device according to claim 12, wherein, when writing a voltage of the any one of the plurality of data signal lines to the holding capacitor as a data voltage, the write control switching element and the threshold compensation switching element are controlled to an on state, and the first light emission control switching element, the second light emission control switching element, and the first initialization switching element are controlled to an off state.

14. The method for driving a display device according to claim 13, wherein, when the display element is to be driven based on the holding voltage of the holding capacitor, the first light emission control switching element and the second light emission control switching element are controlled to an on state, and the write control switching element, the threshold compensation switching element, the first initialization switching element, and the second initialization switching element are controlled to an off state.

15. The method for driving a display device according to claim 11, wherein in a pixel circuit to which the each scanning signal line is connected, a voltage between the first and second conduction terminals of the first initialization switching element during a period when the display element is to be driven based on the holding voltage of the holding capacitor is smaller than a voltage between the first and second conduction terminals of the first initialization switching element during a period when the first terminal of the display element is to be initialized.

* * * * *